US008845145B1

(12) United States Patent
Tam et al.

(10) Patent No.: US 8,845,145 B1
(45) Date of Patent: Sep. 30, 2014

(54) APPARATUS AND METHOD OF INSTALLATION FOR A REFLECTOR ASSEMBLY WITH ONE OR MORE CONNECTORS

(71) Applicants: Amos Tam, Atlanta, GA (US); Grzegorz Wronski, Peachtree City, GA (US)

(72) Inventors: Amos Tam, Atlanta, GA (US); Grzegorz Wronski, Peachtree City, GA (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 13/954,385

(22) Filed: Jul. 30, 2013

Related U.S. Application Data

(62) Division of application No. 13/188,768, filed on Jul. 22, 2011, now Pat. No. 8,511,867.

(51) Int. Cl.

| | |
|---|---|
| ***F21V 15/00*** | (2006.01) |
| ***F21V 17/00*** | (2006.01) |
| ***F21V 11/00*** | (2006.01) |
| ***B60Q 1/00*** | (2006.01) |
| ***B60Q 3/00*** | (2006.01) |
| ***F21V 21/00*** | (2006.01) |
| ***F21V 21/08*** | (2006.01) |
| ***F21V 21/18*** | (2006.01) |
| ***F21S 8/06*** | (2006.01) |
| ***F21V 17/10*** | (2006.01) |

(52) U.S. Cl.
CPC ..... *F21V 17/10* (2013.01)
USPC ..... 362/365; 362/364; 362/368; 362/396; 362/402; 362/408

(58) Field of Classification Search
USPC ..... 362/147, 148, 150, 296.01, 341, 344, 362/364–366, 368, 396, 404, 408, 433, 457, 362/458, 549; 248/560–621
See application file for complete search history.

(56) References Cited

U.S. PATENT DOCUMENTS

| | | | | |
|---|---|---|---|---|
| 3,609,338 | A | 9/1971 | Kripp | |
| 3,697,742 | A | 10/1972 | Bobrick | |
| 4,039,822 | A * | 8/1977 | Chan et al. | 362/296.02 |
| 4,188,656 | A | 2/1980 | Howard | |
| 4,475,147 | A * | 10/1984 | Kristofek | 362/148 |

(Continued)

OTHER PUBLICATIONS

Cooper Lighting; Iris; PLR4X4; Specification Sheet; Feb. 29, 2008.

(Continued)

*Primary Examiner* — Jong-Suk (James) Lee
*Assistant Examiner* — Alexander Garlen
(74) *Attorney, Agent, or Firm* — King & Spalding LLP

(57) ABSTRACT

A reflector assembly and method for installing into a collar. The reflector assembly includes a reflector, a frame surrounding and being coupled to a portion of the reflector, and one or more connectors coupled to the frame. Each connector includes a base portion coupled to the frame, a first finger, and a biasing portion. The first finger and the biasing portion extend in a generally upward direction from a portion of the base portion; however the first finger is angled away from the reflector while the biasing portion is angled toward the reflector. The biasing portion exerts a force on the side of the reflector when the first finger portion is compressed inwardly towards a side of the reflector. The reflector assembly is installed into a collar by inserting the reflector assembly into the collar and allowing first finger to compress toward the reflector and then away from it.

20 Claims, 14 Drawing Sheets

(56) References Cited

U.S. PATENT DOCUMENTS

| | | | | |
|---|---|---|---|---|
| 4,760,510 | A * | 7/1988 | Lahti | 362/365 |
| 4,969,072 | A | 11/1990 | Pye | |
| 5,931,432 | A * | 8/1999 | Herold et al. | 248/343 |
| 6,000,818 | A * | 12/1999 | Caluori | 362/365 |
| 6,361,193 | B1 * | 3/2002 | Gabrius et al. | 362/365 |
| 7,186,008 | B2 | 3/2007 | Patti | |
| 7,374,308 | B2 * | 5/2008 | Sevack et al. | 362/147 |
| 7,500,766 | B1 * | 3/2009 | Reynolds | 362/364 |
| 7,530,717 | B2 | 5/2009 | Magisano et al. | |
| 7,625,105 | B1 * | 12/2009 | Johnson | 362/364 |
| 7,654,705 | B2 | 2/2010 | Czech et al. | |
| 7,722,208 | B1 * | 5/2010 | Dupre et al. | 362/147 |
| 7,748,868 | B2 | 7/2010 | Patti et al. | |
| 7,784,979 | B2 * | 8/2010 | Wronski et al. | 362/364 |
| 7,862,214 | B2 * | 1/2011 | Trott et al. | 362/365 |
| 7,909,487 | B1 * | 3/2011 | Venetucci et al. | 362/364 |
| 8,511,867 | B1 | 8/2013 | Tam et al. | |

OTHER PUBLICATIONS

Visual Newsletter; "Introducing Gotham Microflange,"Gotham Architectural Downlighting; ECOS MFLG (Microflange Trim Round); Product Specifications; Feb. 2010.

USAI, LEDs; "Recessed LED accent lighting offers powerful potential for interior spaces," Trim and Lamping Installation; Product Specification May/Jun. 2010.

No. Eight Lighting, "No. Eight Lighting Introduces Wall Wash Lamp Module," Specification Sheet; May 2009.

Cooper Lighting, Installation Instructions; RSA Quiet Ceiling Square Trim; Jun. 8, 2010.

* cited by examiner

APPARATUS AND METHOD OF INSTALLATION FOR A REFLECTOR ASSEMBLY WITH ONE OR MORE CONNECTORS

CROSS-REFERENCES TO RELATED APPLICATIONS

This application is a divisional application of and claims priority under 35 U.S.C. §120 to U.S. patent application Ser. No. 13/188,768, titled "Apparatus And Method For Providing Adjustable Lip Heights For Plaster Applications On A Ceiling Surface," filed Jul. 22, 2011. The complete disclosure of the foregoing priority application is hereby fully incorporated by reference herein.

TECHNICAL FIELD

The present invention relates generally to lighting fixtures. More specifically, the present invention relates to an apparatus and method for providing adjustable lip heights for plaster applications when installing a recessed lighting fixture to a ceiling and to an apparatus and method for securing a reflector assembly into a collar.

BACKGROUND

Lighting systems, such as ceiling-, wall-, or surface-mounted lighting fixtures or luminaires, commonly illuminate spaces in which people live, work, or play. One type of lighting system, or luminaire, is the recessed lighting fixture, which is typically installed within an aperture formed in a ceiling. The term "luminaire", as used herein, generally refers to a system for producing, controlling, and/or distributing light for illumination. A luminaire can be a system that outputs or distributes light into an environment so that people can observe items in the environment. Such a system could be a complete lighting unit including one or more lamps; sockets for positioning and protecting lamps and for connecting lamps to a supply of electric power; optical elements for distributing light; and mechanical components for supporting or attaching the luminaire. Luminaires are also sometimes referred to as "lighting fixtures" or as "light fixtures." A lighting fixture that has a socket for a bulb, but no inserted bulb, can still be considered a luminaire.

Some conventional recessed lighting fixtures include a housing, one or more support mechanisms, a lamp source, and a trim. The trim can be referred to as a reflector, a lower reflector, or a lower shielding. The trim typically consists of a reflector having an integrated flange or a non-integrated trim ring. One example of the housing includes a planar platform having an opening extending therethrough and a cylindrical can extending in an upward direction above the opening. The support mechanism is typically coupled to the housing and is mounted to one or more support structures, such as a support beam, positioned immediately above the ceiling. Once mounted to the support structure, the opening is typically aligned and positioned above the aperture formed in the ceiling. The lamp source is disposed within the can and is oriented to emit light through the opening and the aperture into the illumination area, such as a room. The trim ring is typically ring-shaped, square-shaped, or rectangular-shaped and is coupled to a lower portion of the trim. At least a portion of the trim ring is disposed below the ceiling and is positioned generally circumferentially around the opening of the trim and adjacent to the ceiling. The trim is designed to cover any space formed between the perimeter of the opening and the perimeter of the aperture. However, this trim ring can be aesthetically unappealing to an observer standing in the illuminated space.

Other conventional recessed lighting fixtures do not use the trims with the integrated or the non-integrated flange. Instead, these conventional recessed lighting fixtures use a rimless adapter that disappears in the ceiling once the ceiling is finished, for example, once plastered. The rimless adapter is directly, or indirectly, coupled to the housing at one end, while the other end is disposed below the ceiling and positioned adjacent to the ceiling surface. The portion disposed below the ceiling includes a perforated planar area and a lip extending elevationally below the perforated planar area. The distance that the lip extends elevationally below the perforated planar area is referred to as a lip height. The perforated planar area is disposed below the ceiling and positioned adjacent to the ceiling surface. The perforated planar area allows for plaster to adhere to it. The desired lip height is dependent upon the surface of the ceiling that is to be plastered, the type of plastering that is chosen, and/or the technique used in plastering the ceiling. Example lip heights include 1/16", 1/8", 3/16" and 1/4". According to conventional rimless adapters, each rimless adapter provides for a single lip height. Thus, depending upon which type of finishing is performed, a different rimless adapter is to be used. This becomes costly and inefficient for manufacturers, contractors, and/or consumers to make and/or purchase various different rimless adapters, each having different lip heights.

SUMMARY

An exemplary embodiment of the invention includes an apparatus. The apparatus can include a first frame and a second frame. The first frame can include an inner edge, an outer edge, and a base extending from the inner edge to the outer edge. The base can include a first surface and a second surface facing an opposite direction than the first surface. The second frame can include an inner edge, an outer edge, a base extending from the inner edge to the outer edge, and a sidewall extending substantially perpendicularly from the inner edge. The sidewall can include a lip portion that can be inserted adjacently through the inner edge of the first frame from the first surface of the first frame and extending beyond the second surface of the first frame. The first frame can be coupled to the second frame in at least a first orientation and a second orientation. The lip portion can have a first length when coupled in the first orientation and can have a second length when coupled in the second orientation. The first length can be smaller than the second length.

Another exemplary embodiment of the invention includes a reflector assembly. The reflector assembly can include a reflector a frame, and one or more connectors. The frame can surround a portion of the reflector and can be coupled to at least a portion of the reflector. The one or more connectors can be coupled to the frame. Each connector can include a base portion, a first finger portion, and a biasing portion. The base portion can be coupled to the frame. The first finger portion can extend in a generally upward direction from a portion of the base portion towards a top portion of the reflector and generally angled away from the reflector. The biasing portion can be extending in a generally upward and angled direction from a portion of the base portion towards the reflector.

Another exemplary embodiment of the invention includes a method for installing a reflector assembly into a collar. The method can include providing a collar. The collar can include a bottom end, a top end, and a sidewall extending from the bottom end to the top end. The sidewall can surround an opening formed therein. The method can also include orienting a reflector assembly below the bottom end of the collar. The reflector assembly can include a reflector, a frame, and one or more connectors. The frame can surround a portion of the reflector and can be coupled to at least a portion of the reflector. The one or more connectors can be coupled to the frame. Each connector can include a base portion, a first finger portion, and a biasing portion. The base portion can be coupled to the frame. The first finger portion can extend in a generally upward direction from a portion of the base portion towards a top portion of the reflector and generally angled away from the reflector. The biasing portion can extend in a generally upward and angled direction from a portion of the base portion towards the reflector. The method also can include inserting the reflector assembly into the opening of the collar. The method also can include compressing the first finger toward the reflector, where the biasing portion can exert a force on the reflector. The method can further include moving the first finger away from the reflector once a portion of the first finger has passed through the opening of the collar.

BRIEF DESCRIPTION OF THE DRAWINGS

The foregoing and other features and aspects of the invention are best understood with reference to the following description of certain exemplary embodiments, when read in conjunction with the accompanying drawings, wherein.

Figure 1:
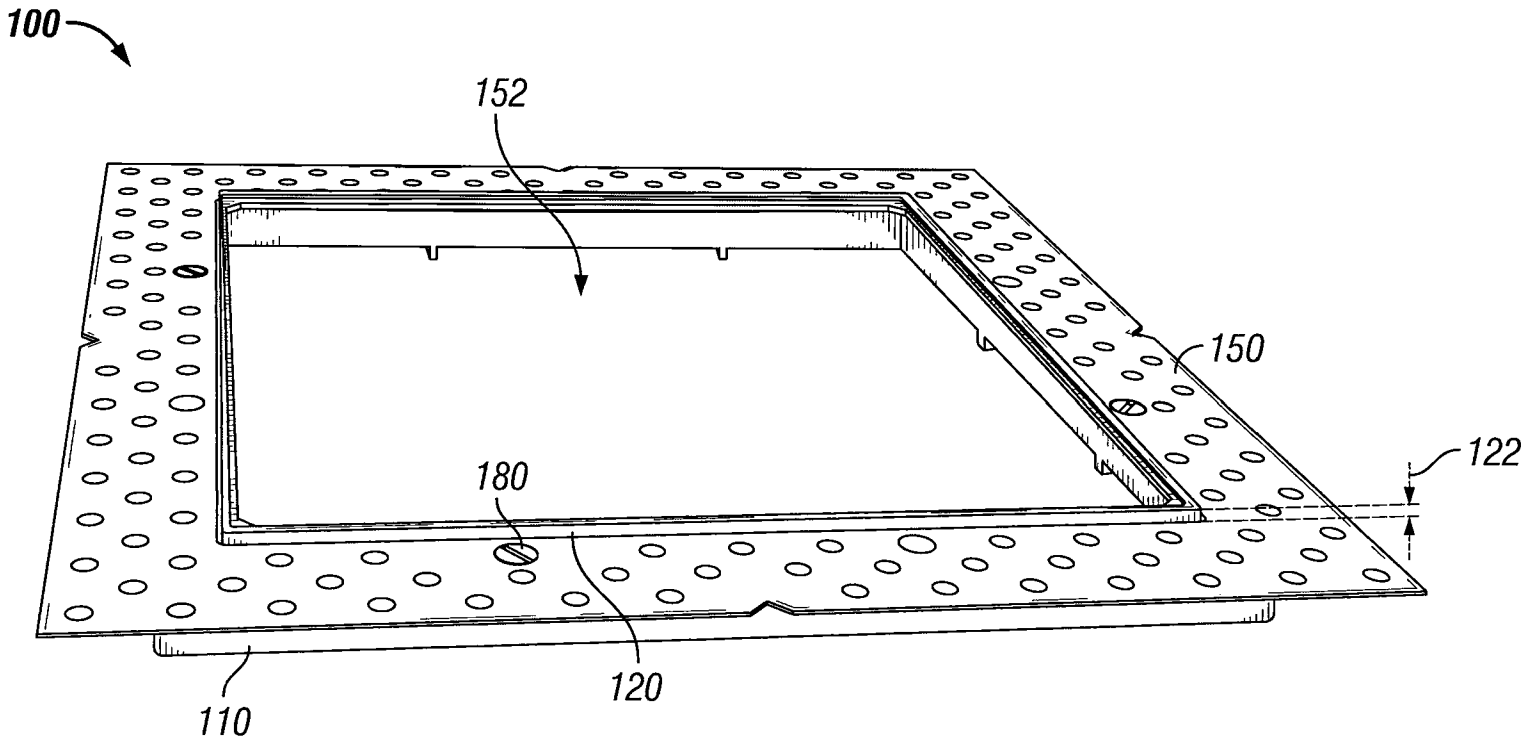
FIG. 1 is a perspective view of a rimless adapter in accordance with an exemplary embodiment of the present invention.

The drawings illustrate only exemplary embodiments of the invention and are therefore not to be considered limiting of its scope, as the invention may admit to other equally effective embodiments.

BRIEF DESCRIPTION OF EXEMPLARY EMBODIMENTS

The present invention is directed to an apparatus and method for providing adjustable lip heights for plaster applications when installing a recessed lighting fixture to a ceiling. Although the exemplary embodiment described below relates to recessed lighting fixtures, other exemplary embodiments of the invention relate to any fixture being installed to a wall or ceiling that is to be rimless. The invention is better understood by reading the following description of non-limiting, exemplary embodiments with reference to the attached drawings, wherein like parts of each of the figures are identified by like reference characters, and which are briefly described as follows.

FIG. 1 is a perspective view of a rimless adapter 100 in accordance with an exemplary embodiment of the present invention. Referring to FIG. 1, the rimless adapter 100 includes a lower frame 110 and a perforated frame 150. In certain exemplary embodiments, the rimless adapter 100 also includes one or more first attachment devices 180 and one or more second attachment devices 490 (FIG. 4), which is similar to the first attachment devices 180 according to certain exemplary embodiments. The lower frame 110 and the perforated frame 150 are dimensioned to have a portion of the lower frame 110 be inserted through a passageway 152 formed within the perforated frame 150. The portion of the lower frame 110 that is inserted through the passageway 152 and extends beyond the perforated frame 150 is referred to as a lip 120. The distance that this lip 120 extends beyond the perforated frame 150 is referred to as a lip height 122. The first attachment devices 180 are used to couple the perforated frame 150 to the lower frame 110. The second attachment devices 490 (FIG. 4) are disposed between the perforated frame 150 and the lower frame 110 and are used to couple the rimless adapter 100 to a remaining portion of the fixture (not shown) that is disposed within the ceiling.

Figure 2A:
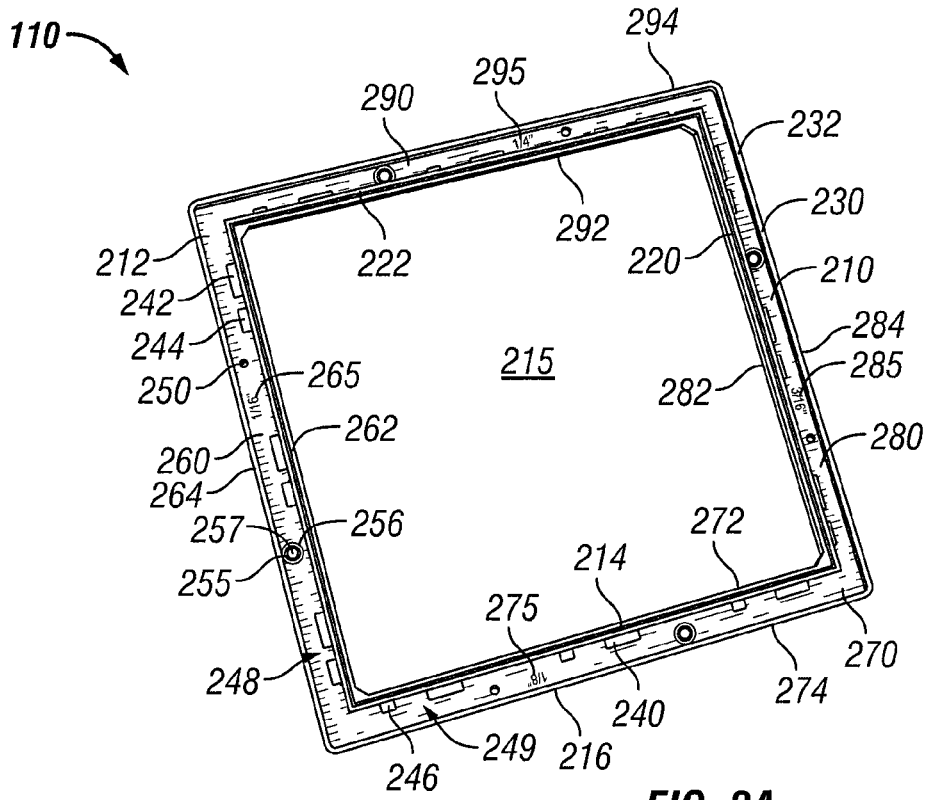
FIG. 2A is a perspective view of a lower frame of FIG. 1 in accordance with an exemplary embodiment of the present invention.
Figure 2B:
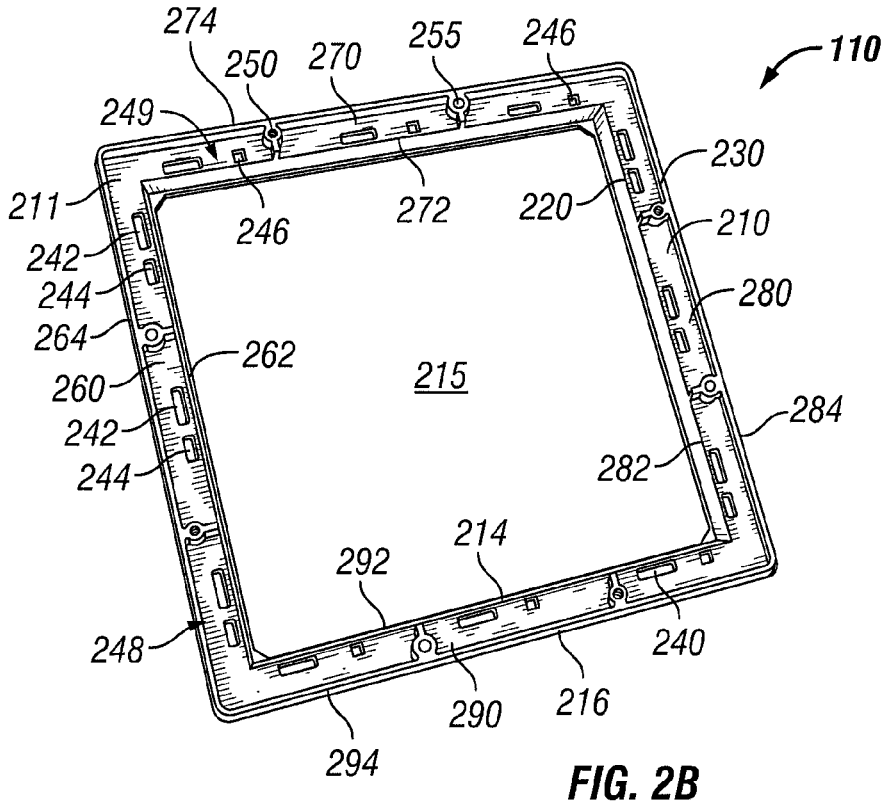
FIG. 2B is another perspective view of the lower frame of FIG. 1 in accordance with an exemplary embodiment of the present invention.

FIGS. 2A and 2B are perspective views of the lower frame 110 in accordance with an exemplary embodiment of the present invention. Referring to FIGS. 1-2B, the lower frame 110 has a substantially square-shaped profile and includes a base 210, an inner wall 220, an outer wall 230, and one or more slots 240 formed circumferentially around and through the base 210. In certain exemplary embodiments, the lower frame 110 also includes one or more channels 250 formed circumferentially around and through the base 210. In certain exemplary embodiments, the lower frame 110 includes one or more captured mounting holes 255 formed circumferentially around and through the base 210. The lower frame 110 is fabricated using die cast aluminum. However, any suitable material known to persons having ordinary skill in the art, such as sheet metal or a polymer material, is used to fabricate the lower frame 110 in other exemplary embodiments.

The base 210 is substantially planar and includes a first surface 211 and a second surface 212 facing a direction opposite the first surface 211. The base 210 also includes an inner edge 214 that surrounds a cavity 215 extending through the base 210 and an outer edge 216 which defines the outer shape of the lower frame 110. The inner edge 214 forms a square shaped profile. Similarly, the outer edge 216 also forms a square shaped profile. In other exemplary embodiments, at least one of the inner edge 214 or the outer edge 216 has a differently shaped profile, such as a rectangular or a circular shape.

The base 210 can be seen as including a first side 260, a second side 270, a third side 280, and a fourth side 290. The first side 260 and the third side 280 are disposed substantially parallel to one another. The second side 270 is disposed substantially perpendicular to the first side 260 and the third side 280 and extends from an end of the first side 260 to an end of the third side 280. Similarly, the fourth side 290 is disposed substantially perpendicular to the first side 260 and the third side 280 and extends from an opposite end of the first side 260 to an opposite end of the third side 280. Each of the first side 260, the second side 270, the third side 280, and the fourth side 290 are integrally formed as a single component and the cavity 215 is formed during the manufacturing process, such as during the casting process, in certain exemplary embodiments. However, in other exemplary embodiments, one or more sides 260, 270, 280, 290 are separately formed and thereafter coupled together. Alternatively, a square-shaped platform (not shown) is fabricated and the cavity 215 is subsequently formed within the platform, such as by cutting through the platform to form the base 210.

The first side 260 includes a first inner edge 262 and a first outer edge 264, where the first inner edge 262 borders a portion of the cavity 215. The second side 270 includes a second inner edge 272 and a second outer edge 274, where the second inner edge 272 borders a portion of the cavity 215. The third side 280 includes a third inner edge 282 and a third outer edge 284, where the third inner edge 282 borders a portion of the cavity 215. The fourth side 290 includes a fourth inner edge 292 and a fourth outer edge 294, where the fourth inner edge 292 borders a portion of the cavity 215. Thus, the first inner edge 262, the second inner edge 272, the third inner edge 282, and the fourth inner edge 292 collectively form the inner edge 214. Likewise, the first outer edge 264, the second outer edge 274, the third outer edge 284, and the fourth outer edge 294 collectively form the outer edge 216.

The inner wall 220 is oriented substantially perpendicular to the base 210. The inner wall 220 is positioned along the inner edge 214 and extends in a direction away from the second surface 212 of the base 210 such that a distal end 222 of the inner wall 220 is closer to the second surface 212 than the first surface 211. A top portion of this inner wall 220, which includes the distal end 222, forms the lip height 122 once the lower frame 110 is coupled to the perforated frame 150 and partially inserted within the perforated frame 150. The formation of the lip height 122 is described in further detail below.

The outer wall 230 also is oriented substantially perpendicular to the base 210. The outer wall 230 is positioned along the outer edge 216 and extends in both directions in certain exemplary embodiments. However, in other exemplary embodiments, the outer wall 230 extends only in a direction away from the second surface 212 of the base 210 such that a distal end 232 of the outer wall 230 is closer to the second surface 212 than the first surface 211. The distal end 222 of the inner wall 220 extends a greater distance away from the second surface 212 than does the distal end 232 of the outer wall 230. When viewing the lower frame 110, the second surface 212 of the base 210 is recessed between the inner wall 220 and the outer wall 230.

With respect to the one or more slots 240, the one or more channels 250, and the one or more captured mounting holes 255, each are described with respect to the first side 260, the second side 270, the third side 280, and the fourth side 290. In certain exemplary embodiments, the slot 240 is dimensioned to form one of a long slot 242, an intermediate slot 244, or a short slot 246, which is further described below. Further, in certain exemplary embodiments, two or more slots 240 of similar or different lengths are positioned linear and adjacent to one another to form at least one of a first slot set 248 or a second slot set 249, which also is further described below.

The first side 260 includes a label 265, one or more first slot sets 248, at least one channel 250, and at least one captured mounting hole 255. The label 265 is imprinted on the second surface 212 of the base 210. However, the label 265 is coupled to the second surface 212 according to methods and/or devices known to persons having ordinary skill in the art with the benefit of the present disclosure, such as by using a plate and affixing it to the second surface 212 or by writing it onto the second surface 212 using a writing instrument, such as a pen, a marker, or a pencil. The label 265 indicates one of several different lip heights 122 that is capable of being provided by the coupling of the lower frame 110 to the perforated frame 150. According to one exemplary embodiment, the label 265 is indicated with "1/16"'"; however, other symbols, letters, numbers, and/or marks are used to provide indication of one of the several achievable lip heights 122.

Each first slot set 248 includes a long slot 242 and an intermediate slot 244 linearly positioned near the long slot 242, and where both the long slot 242 and the intermediate slot 244 are positioned along the length of the first side 260. Hence, a portion of the base 210 separates the long slot 242 and the intermediate slot 244. The long slot 242 is dimensioned to receive a first step 341 (FIG. 3B), a second step 343 (FIG. 3B), and a third step 345 (FIG. 3B) of a stairstep 340

(FIG. 3B) positioned on the perforated frame 150, which is further described below. Also, the long slot 242 extends through the base 210. However, in certain exemplary embodiments, the long slot 242 is formed at the second surface 212 of the base 210 and extends towards the first surface 211. The intermediate slot 244 is dimensioned to receive the first step 341 (FIG. 3B) and the second step 343 (FIG. 3B) of the stairstep 340 (FIG. 3B). Similarly, the intermediate slot 244 extends through the base 210. However, in certain exemplary embodiments, the intermediate slot 244 is formed at the second surface 212 of the base 210 and extends towards the first surface 211. There are three first slot sets 248 formed linearly along the length of the first side 260 and adjacent the first inner edge 262. In certain exemplary embodiments, when viewing the first side 260 from the end adjacent to the second side 270 to the opposite end adjacent the fourth side 290, the first slot set 248 begins with the intermediate slot 244 and is followed by the long slot 242. Also, in certain exemplary embodiments at least one of the first slot sets 248 is substantially equidistantly positioned apart from two adjacently positioned first slot sets 248. Although three first slot sets 248 are formed in the first side 260, greater or fewer first slot sets 248 are formed in the first side 260 in other exemplary embodiments. Also, although one example of dimensions is provided for the long slot 242 and the intermediate slot 244, the dimensions are different in other exemplary embodiments. Further, the positioning of the first slot sets 248 is nonlinear and/or not adjacent to the first inner edge 262 in other exemplary embodiments.

The channel 250 is formed through the base 210 and is sized to receive at least a portion of the first attachment device 180. In some exemplary embodiments, the channel 250 is threaded. The channel 250 is used for coupling the perforated frame 150 to the lower frame 110. Although one structure is described for coupling the perforated frame 150 to the lower frame 110, other devices known to persons having ordinary skill in the art with the benefit of the present disclosure are used in other exemplary embodiments.

Figure 4:
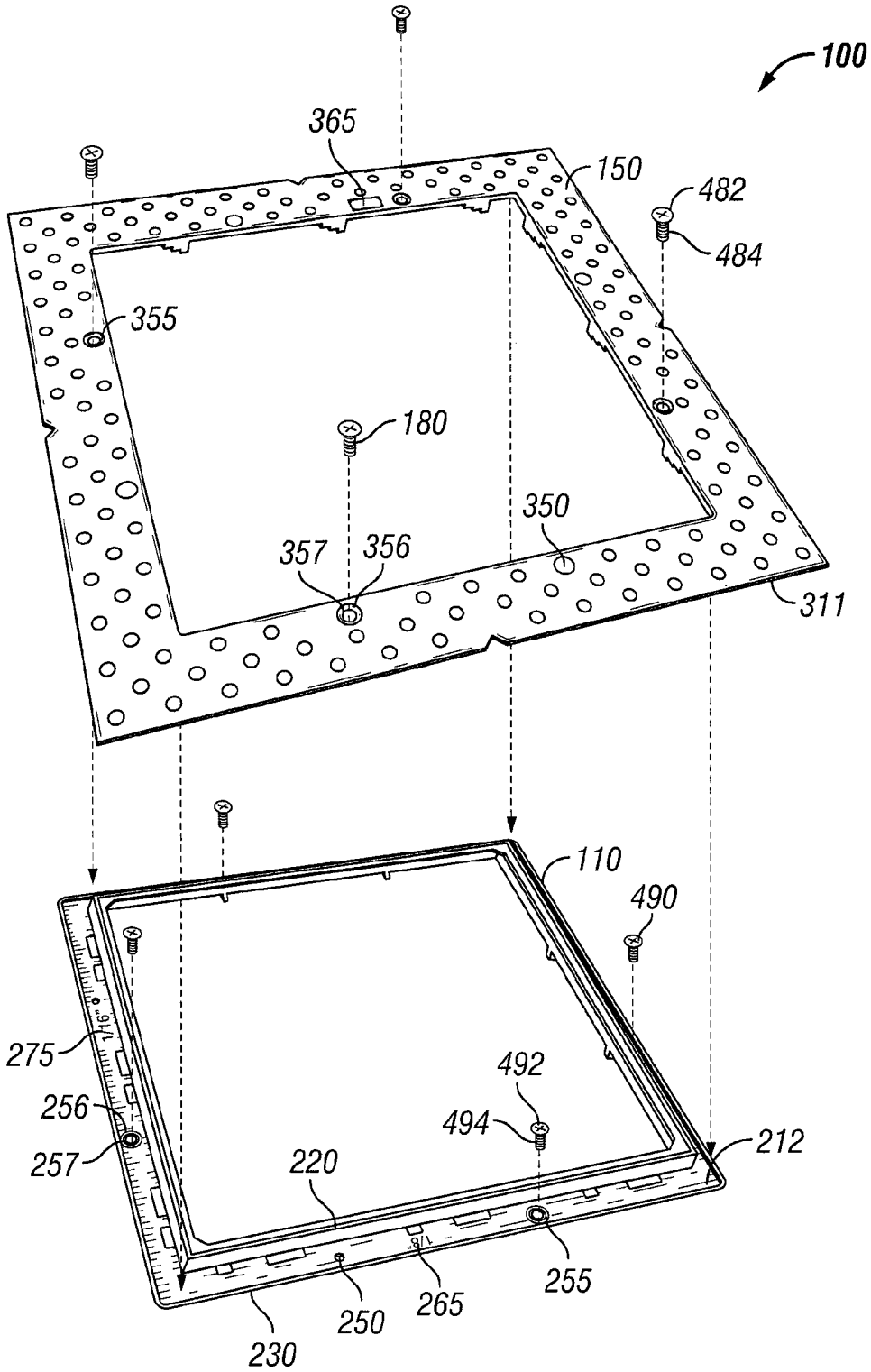
FIG. 4 is an exploded view of the rimless adapter of FIG. 1 in accordance with an exemplary embodiment of the present invention.

The captured mounting hole 255 also is formed through the base 210. The captured mounting hole 255 includes a first portion 256 and a second portion 257. The first portion 256 is formed within the base 210 and extends from the second surface 212 toward the first surface 211 to a desired depth which is about the thickness of a head portion 492 (FIG. 4) of the second attachment device 490 (FIG. 4). The second portion 257 is formed within the base 210 and extends from the first surface 211 to the first portion 256. The first portion 256 is dimensioned to receive the head portion 492 (FIG. 4) of the second attachment device 490 (FIG. 4), while the second portion 257 is dimensioned to receive a body portion 494 (FIG. 4) of the second attachment device 490 (FIG. 4). Thus, once the second attachment device 490 (FIG. 4) is inserted into the captured mounting hole 255, the top of the head portion 492 (FIG. 4) lies substantially planar with the second surface 212 of the base 210. The captured mounting hole 255 is used for coupling the lower frame 110 to the fixture's housing located within the ceiling. Although one structure is described for coupling the lower frame 110 to the housing of the fixture, other devices known to persons having ordinary skill in the art with the benefit of the present disclosure are used in other exemplary embodiments.

The third side 280 is similar to the first side 260 and therefore is described briefly. The third side 280 includes a label 285, one or more first slot sets 248, at least one channel 250, and at least one captured mounting hole 255. The label 285 is imprinted on the second surface 212 of the base 210. However, the label 285 is coupled to the second surface 212 according to methods and/or devices known to persons having ordinary skill in the art with the benefit of the present disclosure, such as by using a plate and affixing it to the second surface 212 or by writing it onto the second surface 212 using a writing instrument, such as a pen, a marker, or a pencil. The label 285 indicates one of several different lip heights 122 that is capable of being provided. According to one exemplary embodiment, the label 285 is indicated with "3/16""; however, other symbols, letters, numbers, and/or marks are used to provide indication of one of the several achievable lip heights 122. The first slot sets 248 of the third side 280 are similar to those formed in the first side 260 and therefore are not described in further detail, except that each long slot 242 formed in the third side 280 is positioned opposite the corresponding long slot 242 formed in the first side 260 and that each intermediate slot 244 formed in the third side 280 is positioned opposite the corresponding intermediate slot 244 formed in the first side 260. Thus, in certain exemplary embodiments, when viewing the third side 280 from the end adjacent to the fourth side 290 to the opposite end adjacent the second side 270, the first slot set 248 begins with the long slot 242 and is followed by the intermediate slot 244. Further, the channel 250 and the captured mounting hole 255 are similar to those formed in the first side 260 and therefore are not described in further detail again.

The second side 270 includes a label 275, one or more second slot sets 249, at least one channel 250, and at least one captured mounting hole 255. The label 275 is imprinted on the second surface 212 of the base 210. However, the label 275 is coupled to the second surface 212 according to methods and/or devices known to persons having ordinary skill in the art with the benefit of the present disclosure, such as by using a plate and affixing it to the second surface 212 or by writing it onto the second surface 212. The label 275 indicates one of several different lip heights 122 that is capable of being provided. According to one exemplary embodiment, the label 275 is indicated with "1/8""; however, other symbols, letters, numbers, and/or marks are used to provide indication of one of the several achievable lip heights 122.

Each second slot set 249 includes the long slot 242 and the short slot 246 linearly positioned near the long slot 242, and where both the long slot 242 and the short slot 246 are positioned along the length of the second side 270. Hence, a portion of the base 210 separates the long slot 242 and the short slot 246. The long slot 242 has been previously described and therefore is not described in duplicate herein. The short slot 246 is dimensioned to receive the first step 341 (FIG. 3B) of the stairstep 340 (FIG. 3B). The short slot 246 extends through the base 210. However, in certain exemplary embodiments, the short slot 246 is formed at the second surface 212 of the base 210 and extends towards the first surface 211. There are three second slot sets 249 formed linearly along the length of the second side 270 and adjacent the second inner edge 272. In certain exemplary embodiments, when viewing the second side 270 from the end adjacent to the third side 280 to the opposite end adjacent the first side 260, the second slot set 249 begins with the long slot 242 and is followed by the short slot 246. Also, at least one of the second slot sets 249 is substantially equidistantly positioned apart from the adjacently positioned second slot sets 249. Although three second slot sets 249 are formed in the second side 270, greater or fewer second slot sets 249 are formed in the second side 270 in other exemplary embodiments. Also, although one example of dimensions is provided for the long slot 242 and the short slot 246, the dimensions are different in other exemplary embodiments. Further, the positioning of the second slot sets 249 is nonlinear and/or not adjacent to the second inner edge 272 in other exemplary embodiments. Further, the channel 250 and the captured mounting hole 255 are similar to those formed in the first side 260 and therefore are not described in further detail again.

The fourth side 290 is similar to the second side 270 and therefore is described briefly. The fourth side 290 includes a label 295, one or more second slot sets 249, at least one channel 250, and at least one captured mounting hole 255. The label 295 is imprinted on the second surface 212 of the base 210. However, the label 295 is coupled to the second surface 212 according to methods and/or devices known to persons having ordinary skill in the art with the benefit of the present disclosure, such as by using a plate and affixing it to the second surface 212 or by writing it onto the second surface 212 using a writing instrument, such as a pen, a marker, or a pencil. The label 295 indicates one of several different lip heights 122 that is capable of being provided. According to one exemplary embodiment, the label 295 is indicated with "¼""; however, other symbols, letters, numbers, and/or marks are used to provide indication of one of the several achievable lip heights 122. The second slot sets 249 of the fourth side 290 are similar to those formed in the second side 270 and therefore are not described in further detail, except that each long slot 242 formed in the fourth side 290 is positioned opposite the corresponding long slot 242 formed in the second side 270 and that each short slot 246 formed in the fourth side 290 is positioned opposite the corresponding short slot 246 formed in the second side 270. Thus, in certain exemplary embodiments, when viewing the fourth side 280 from the end adjacent to the first side 260 to the opposite end adjacent the third side 280, the second slot set 249 begins with the short slot 246 and is followed by the long slot 242. Further, the channel 250 and the captured mounting hole 255 are similar to those formed in the first side 260 and therefore are not described in further detail again.

Figure 3A:
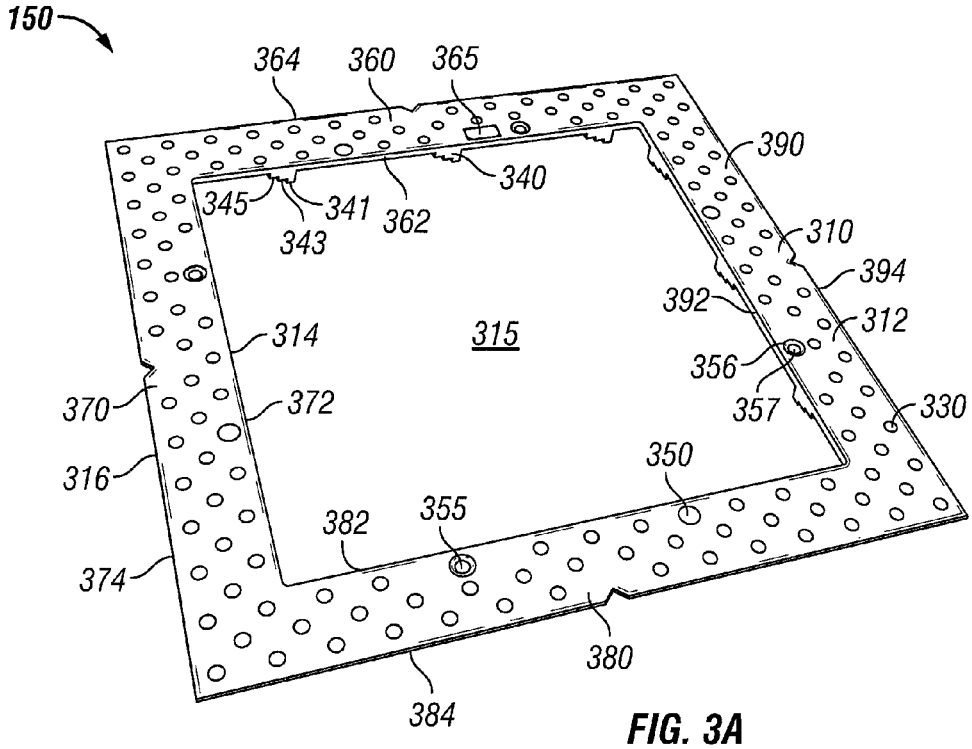
FIG. 3A is a perspective view of a perforated frame of FIG. 1 in accordance with an exemplary embodiment of the present invention.
Figure 3B:
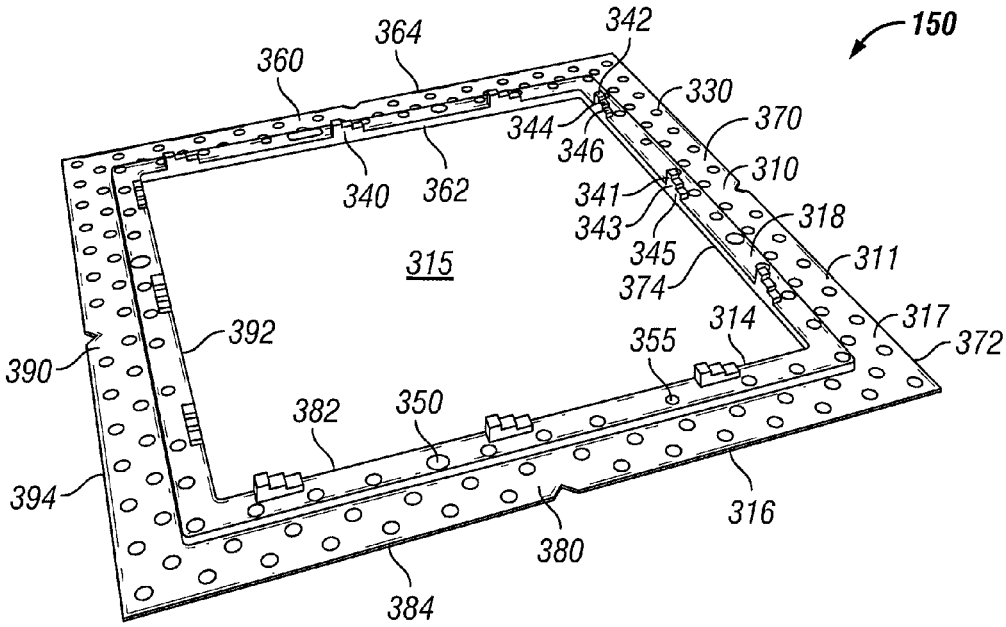
FIG. 3B is another perspective view of the perforated frame of FIG. 1 in accordance with an exemplary embodiment of the present invention.
Figure 3C:
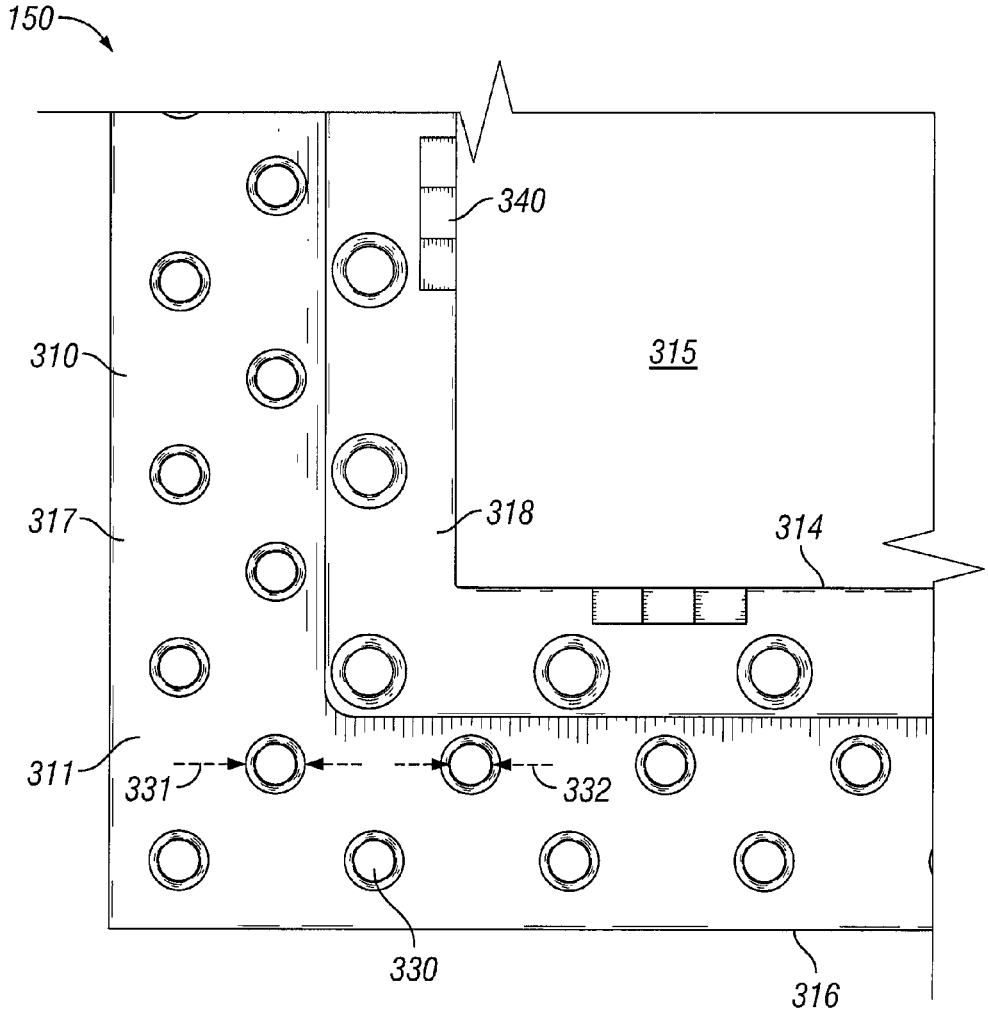
FIG. 3C is a front view of a portion of the perforated frame of FIG. 1 in accordance with an exemplary embodiment of the present invention.

FIGS. 3A and 3B are perspective views of a perforated frame 150 in accordance with an exemplary embodiment of the present invention. FIG. 3C is a front view of a portion of the perforated frame 150 in accordance with an exemplary embodiment of the present invention Referring to FIGS. 1 and 3A-3C, the perforated frame 150 has a substantially square-shaped profile and includes a base 310, one or more perforated openings 330, and one or more stairsteps 340 formed circumferentially and intermittently around the base 310. In certain exemplary embodiments, the perforated frame 150 also includes one or more channels 350 formed around and through the base 310. In certain exemplary embodiments, the perforated frame 150 includes one or more mounting holes 355 formed around and through the base 310. The perforated frame 150 is fabricated using die cast aluminum. However, any suitable material known to persons having ordinary skill in the art, such as sheet metal or a polymer material, is used to fabricate the perforated frame 150 in other exemplary embodiments.

The base 310 includes a first surface 311 and a second surface 312 facing a direction opposite the first surface 311. The base 310 also includes an inner edge 314 that surrounds a cavity 315 extending through the base 310 and an outer edge 316 which defines the outer shape of the perforated frame 310. The inner edge 314 forms a square shaped profile and is dimensioned to be slightly larger than the inner edge 214 (FIG. 2A). Similarly, the outer edge 316 also forms a square shaped profile. In other exemplary embodiments, at least one of the inner edge 314 or the outer edge 316 has a differently shaped profile, such as a rectangular or a circular shape. The first surface 311 includes an outer portion 317 and an inner portion 318. The outer portion 317 is substantially planar and extends from the outer edge 316 towards the inner edge 314. Similarly, the inner portion 318 is substantially planar and extends from the inner edge 314 to the outer portion 317. In certain exemplary embodiments, the inner portion 318 is elevationally raised compared to the outer portion 317. In certain exemplary embodiments, the width of the inner portion 318 is dimensioned to fit within the space formed between the inner wall 220 (FIG. 2A) and the outer wall 230 (FIG. 2A) when the perforated frame 150 is coupled to the lower frame 110 (FIG. 2A). The second surface 312 is substantially planar.

One or more perforated openings 330 are formed within the base 310. According to certain exemplary embodiments, several perforated openings 330 are formed circumferentially around the base 310 and extend from the second surface 312 to the first surface 311. The perforated openings 330 facilitate plastering on top of the second surface 312 since these openings 330 provide an area for the plaster to adhere itself. In certain exemplary embodiments, as shown in FIG. 3C, one or more perforated openings 330 are tapered in that a first diameter 331 of the perforated opening 330 at the first surface 311 is larger than a second diameter 332 of the perforated opening 330 at the second surface 312. However, in other exemplary embodiments, one or more perforated openings 330 are uniform in diameter or have a diameter at the second surface 312 being larger than the diameter at the first surface 311.

The base 310 can be seen as including a first side 360, a second side 370, a third side 380, and a fourth side 390. The first side 360 and the third side 380 are disposed substantially parallel to one another. The second side 370 is disposed substantially perpendicular to the first side 360 and the third side 380 and extends from an end of the first side 360 to an end of the third side 380. Similarly, the fourth side 390 is disposed substantially perpendicular to the first side 360 and the third side 380 and extends from an opposite end of the first side 360 to an opposite end of the third side 380. Each of the first side 360, the second side 370, the third side 380, and the fourth side 390 are integrally formed as a single component and the cavity 315 is formed during the manufacturing process, such as during the extrusion process, in certain exemplary embodiments. However, in other exemplary embodiments, one or more sides 360, 370, 380, 390 are separately formed and thereafter coupled together. Alternatively, a square-shaped platform (not shown) is fabricated and the cavity 315 is subsequently formed within the platform, such as by cutting through the platform to form the base 310.

The first side 360 includes a first inner edge 362 and a first outer edge 364, where the first inner edge 362 borders a portion of the cavity 315. The second side 370 includes a second inner edge 372 and a second outer edge 374, where the second inner edge 372 borders a portion of the cavity 315. The third side 380 includes a third inner edge 382 and a third outer edge 384, where the third inner edge 382 borders a portion of the cavity 315. The fourth side 390 includes a fourth inner edge 392 and a fourth outer edge 394, where the fourth inner edge 392 borders a portion of the cavity 315. Thus, the first inner edge 362, the second inner edge 372, the third inner edge 382, and the fourth inner edge 392 collectively form the inner edge 314. Likewise, the first outer edge 364, the second outer edge 374, the third outer edge 384, and the fourth outer edge 394 collectively form the outer edge 316.

With respect to the one or more stairsteps 340, the one or more channels 350, and the one or more mounting holes 355, each are described with respect to the first side 360, the second side 370, the third side 380, and the fourth side 390. The first side 360 includes a window 365, one or more stairsteps 340, at least one channel 350, and at least one mounting hole 355. The window 365 is formed within the base 310 and extends from the second surface 312 to the first surface 311. The window 365 has an elongated oval shape, but is shaped differently in other exemplary embodiments. The window 365 is dimensioned so that any one of the labels 265, 275, 285, 295 (FIG. 2A) imprinted on the second surface 212 (FIG. 2A) of the lower frame 110 is visible though the window 365 once the perforated frame 150 is coupled to the lower frame 110 in a desired orientation.

Each stairstep 340 includes the first step 341, the second step 343, and the third step 345. Although each stairstep 340 includes three steps in certain exemplary embodiments, one or more stairsteps 340 have greater or fewer steps in other exemplary embodiments. Each stairstep 340 is positioned on the inner portion 318 of the first surface 311 circumferentially and intermittently along and adjacent to the inner edge 314. However, the positioning of one or more stairsteps 340 is different in other exemplary embodiments. The first step 341 extends outwardly and substantially perpendicularly from the first surface 311. According to some exemplary embodiments, the first step 341 extends about 3/16" away from the first surface 311 and has a substantially planar distal surface 342. However, in other exemplary embodiments, the first step 341 extends a longer or shorter distance away from the first surface 311. The second step 343 is positioned adjacent and linear to the first step 341. The second step 343 extends outwardly and substantially perpendicularly from the first surface 311. According to some exemplary embodiments, the second step 343 extends about 1/8" away from the first surface 311 and has a substantially planar distal surface 344. However, in other exemplary embodiments, the second step 343 extends a longer or shorter distance away from the first surface 311. The third step 345 is positioned adjacent to the second step 343 and linear to both the first step 341 and the second step 343. The third step 345 extends outwardly and substantially perpendicularly from the first surface 311. According to some exemplary embodiments, the third step 345 extends about 1/16" away from the first surface 311 and has a substantially planar distal surface 346. However, in other exemplary embodiments, the third step 345 extends a longer or shorter distance away from the first surface 311. One or more stairsteps 340 are formed as a single component according to some exemplary embodiments. However, one or more stairsteps 340 are formed separately and thereafter assembled together in other exemplary embodiments. In certain exemplary embodiments, one or more stairsteps 340 are formed integrally with the base 310 as a single component. However, in other exemplary embodiments, one or more stairsteps 340 are formed separately from the base 310 and thereafter assembled to the base 310.

The first side 360 includes three stairsteps 340 formed linearly along the length of the first side 360 and adjacent the first inner edge 362. However, the number of stairsteps 340 is different in other exemplary embodiments. In certain exemplary embodiments, when viewing the first surface 311 of the first side 360 from the end adjacent to the fourth side 390 to the opposite end adjacent the second side 370, each stairstep 340 is oriented such that the stairstep 340 begins with the first step 341, followed by the second step 343, and then followed again by the third step 345. Also, in certain exemplary embodiments, one of the stairstep 340 is substantially equidistantly positioned apart from the adjacently positioned stairsteps 340. Further, the positioning of the stairsteps 340 is nonlinear and/or not adjacent to the first inner edge 362 in other exemplary embodiments.

The channel 350 is formed through the base 310 and is sized slightly smaller than the head portion 492 (FIG. 4) of the second attachment device 490 (FIG. 4). The channel 350 is vertically aligned with the captured mounting hole 255 (FIG. 2A) and is used to capture the second attachment device 490 (FIG. 4) so that it cannot be removed once the perforated frame 150 is coupled to the lower frame 110. Also, the channel 350 allows a tool (not shown), such as a screw driver, to access the second attachment device 490 (FIG. 4) without decoupling the lower frame 10 from the perforated frame 150.

The mounting hole 355 also is formed through the base 310. The mounting hole 355 includes a first portion 356 and a second portion 357. The first portion 356 is formed within the base 310 and extends from the second surface 312 toward the first surface 311 to a desired depth which is about the thickness of a head portion 482 (FIG. 4) of the first attachment device 180. The second portion 357 is formed within the base 310 and extends from the first surface 311 to the first portion 356. The first portion 356 is dimensioned to receive the head portion 482 (FIG. 4) of the first attachment device 180, while the second portion 357 is dimensioned to receive a body portion 484 (FIG. 4) of the first attachment device 180. Thus, once the first attachment device 180 is inserted into the mounting hole 355, the top of the head portion 482 (FIG. 4) lies substantially planar with the second surface 312 of the base 310. The mounting hole 355 is vertically aligned with the channel 250 (FIG. 2A) and is used to couple the perforated frame 150 to the lower frame 110. Although one structure is described for coupling the perforated frame 150 to the lower frame 110, other devices known to persons having ordinary skill in the art with the benefit of the present disclosure are used in other exemplary embodiments.

The third side 380 is similar to the first side 360 and therefore is described briefly. The third side 380 includes one or more stairsteps 340, at least one channel 350, and at least one mounting hole 355. The stairsteps 340 of the third side 380 are similar to those formed in the first side 360 and therefore are not described in further detail, except to describe the orientation of each stairstep 340. The third side 380 includes a corresponding number of stairsteps 340 as those in the first side 360. Also, each first step 341 formed in the third side 380 is positioned opposite the corresponding first step 341 formed in the first side 360. Similarly, each second step 343 formed in the third side 380 is positioned opposite the corresponding second step 343 formed in the first side 360. Further, each third step 345 formed in the third side 380 is positioned opposite the corresponding third step 345 formed in the first side 360. Thus, in certain exemplary embodiments, when viewing the third side 380 from the end adjacent to the fourth side 390 to the opposite end adjacent the second side 370, each stairstep 340 begins with the first step 341, followed by the second step 343, and then followed by the third step 345. Further, the channel 350 and the mounting hole 355 are similar to those formed in the first side 360 and therefore are not described in further detail again.

The second side 370 includes one or more stairsteps 340, at least one channel 350, and at least one mounting hole 355. The second side 370 includes three stairsteps 340 formed linearly along the length of the second side 370 and adjacent the second inner edge 372. However, the number of stairsteps 340 is different in other exemplary embodiments. In certain exemplary embodiments, when viewing the first surface 311 of the second side 370 from the end adjacent to the first side 360 to the opposite end adjacent the third side 380, each stairstep 340 is oriented such that the stairstep 340 begins with the first step 341, followed by the second step 343, and then followed again by the third step 345. Also, at least one of the stairsteps 340 is substantially equidistantly positioned apart from the adjacently positioned stairsteps 340. Further, the positioning of the stairsteps 340 is nonlinear and/or not adjacent to the second inner edge 372 in other exemplary embodiments. Further, the channel 350 and the mounting hole 355 are similar to those formed in the first side 360 and therefore are not described in further detail again.

The fourth side 390 is similar to the second side 370 and therefore is described briefly. The fourth side 390 includes one or more stairsteps 340, at least one channel 350, and at least one mounting hole 355. The stairsteps 340 of the fourth side 390 are similar to those formed in the second side 370 and therefore are not described in further detail, except to describe the orientation of each stairstep 340. The fourth side 390 includes a corresponding number of stairsteps 340 as those in the second side 370. Also, each first step 341 formed in the fourth side 390 is positioned opposite the corresponding first step 341 formed in the second side 370. Similarly, each second step 343 formed in the fourth side 390 is positioned opposite the corresponding second step 343 formed in the second side 370. Further, each third step 345 formed in the fourth side 390 is positioned opposite the corresponding third step 345 formed in the second side 370. Thus, in certain exemplary embodiments, when viewing the fourth side 390 from the end adjacent to the first side 360 to the opposite end adjacent the third side 380, each stairstep 340 begins with the first step 341, followed by the second step 343, and then followed by the third step 345. Further, the channel 350 and the mounting hole 355 are similar to those formed in the first side 360 and therefore are not described in further detail again.

FIG. 4 is an exploded view of the rimless adapter 100 in accordance with an exemplary embodiment of the present invention. Referring to FIGS. 1 and 4, the perforated frame 150 is coupled to the lower frame 110 using the first attachment devices 180. The second attachment devices 190 are used for coupling the lower frame 110 to a remaining portion of the light fixture, such as a housing, which can be disposed within a ceiling.

The second attachment device 490 is inserted into one or more corresponding captured mounting holes 255 located within the lower frame 110. In certain exemplary embodiments, four second attachment devices 490 are inserted into four corresponding captured mounting holes 255. According to some exemplary embodiments, the second attachment device 490 is a screw that includes the head portion 492 and the body portion 494 extending from the head portion 492. Once the second attachment device 490 is inserted into the captured mounting hole 255, the head portion 492 is disposed within first portion 256 of the captured mounting hole 255, while a portion of the body portion 494 is disposed within the second portion 257 of the captured mounting hole 255. These second attachment devices 490 are used to couple the rimless adapter 100 to a remaining portion of the fixture (not shown), such as a housing, that is disposed within the ceiling.

The perforated frame 150 is positioned adjacent to the lower frame 110 by positioning the first surface 311 of the perforated frame 150 to face the second surface 212 of the lower frame 110. The window 365 of the perforated frame 150 is positioned in vertical alignment over one of the labels 265, 275, 285 (FIG. 2A), 295 (FIG. 2A) of the lower frame 110, which calls out for the resulting lip height 122. Thus, the perforated frame 150 can be oriented in four different manners, which are further described with respect to FIGS. 5A-8C. At this orientation, each mounting hole 355 of the perforated frame 150 is in vertical alignment with a corresponding channel 250 of the lower frame 110. Additionally at this orientation, each channel 350 of the perforated frame 150 is in vertical alignment with a corresponding captured mounting hole 255 of the lower frame 110. A portion of the inner wall 220 of the lower frame 110 is inserted through the cavity 315 of the perforated frame 110. Also, the inner portion 318 (FIG. 3B) of the perforated frame 150 is inserted into the area formed between the inner wall 220 and the outer wall 230 when the perforated frame 150 is coupled to the lower frame 110.

The first attachment device 180 is inserted into one or more corresponding mounting holes 355 located within the perforated frame 110. In certain exemplary embodiments, four first attachment devices 180 are inserted into four corresponding mounting holes 355. According to some exemplary embodiments, the first attachment device 180 is a screw that includes the head portion 482 and the body portion 484 extending from the head portion 482. Once the first attachment device 180 is inserted into the mounting hole 355, the head portion 482 is disposed within first portion 356 of the mounting hole 355, while a portion of the body portion 484 is disposed within the second portion 357 of the mounting hole 355 and a remaining portion of the body portion 484 is threadedly coupled to the corresponding channel 250 of the lower frame 110. These first attachment devices 180 are used to couple the perforated frame 150 to the lower frame 110.

Figure 5A:
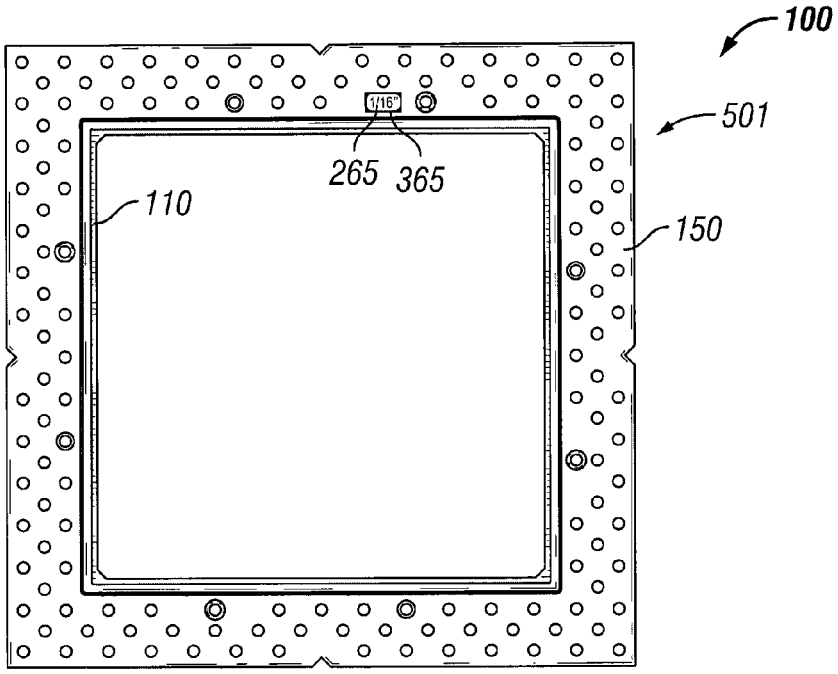
FIG. 5A is a front view of the rimless adapter of FIG. 1 oriented in a first orientation in accordance with an exemplary embodiment of the present invention.
Figure 5B:
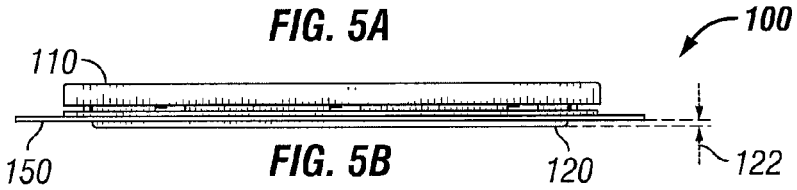
FIG. 5B is a side view of the rimless adapter of FIG. 5A in accordance with an exemplary embodiment of the present invention.
Figure 5C:
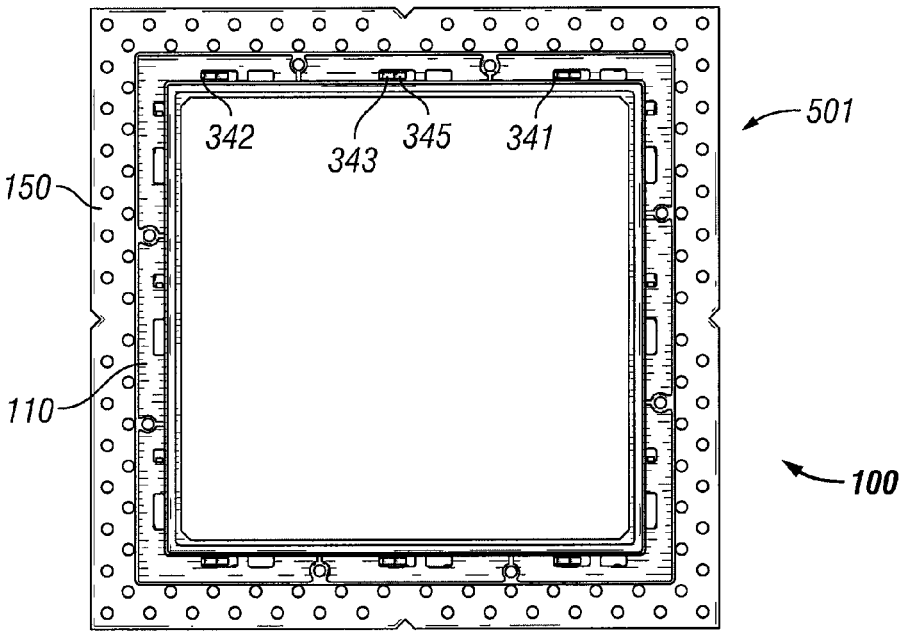
FIG. 5C is a rear view of the rimless adapter of FIG. 5A in accordance with an exemplary embodiment of the present invention.

FIGS. 5A-5C are various views of the rimless adapter 100 oriented in a first orientation 501 in accordance with an exemplary embodiment of the present invention. Referring to FIGS. 5A-5C, the window 365 of the perforated frame 150 is vertically aligned with the label 265 when the perforated frame 150 is coupled to the lower frame 110 in the first orientation 501. In certain exemplary embodiments where the label 265 is indicated with 1/16", the lip height 122 of the lip 120 that is formed is 1/16". Also, each first step's distal surface 342 is disposed on the base's second surface 212 (FIG. 2A) of the lower frame 110 and hence none of steps 341, 343, 345 are disposed and/or inserted within any of the slots 240.

Figure 6A:
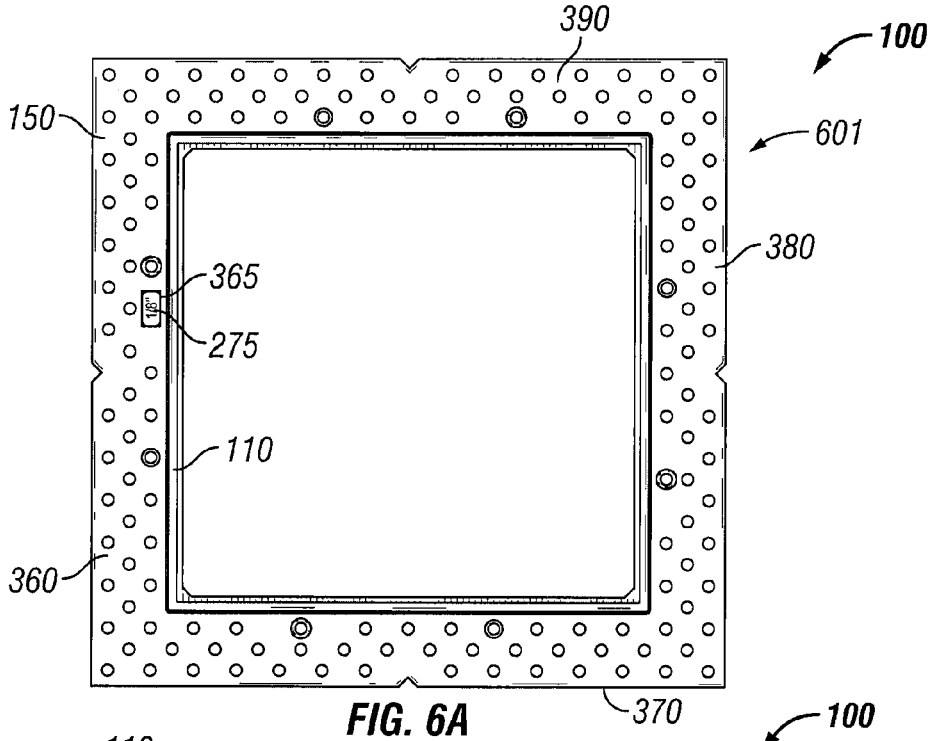
FIG. 6A is a front view of the rimless adapter of FIG. 1 oriented in a second orientation in accordance with an exemplary embodiment of the present invention.
Figure 6B:
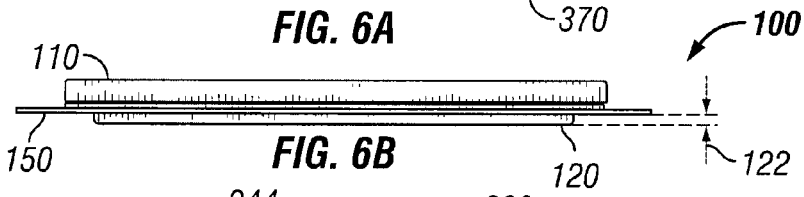
FIG. 6B is a side view of the rimless adapter of FIG. 6A in accordance with an exemplary embodiment of the present invention.
Figure 6C:
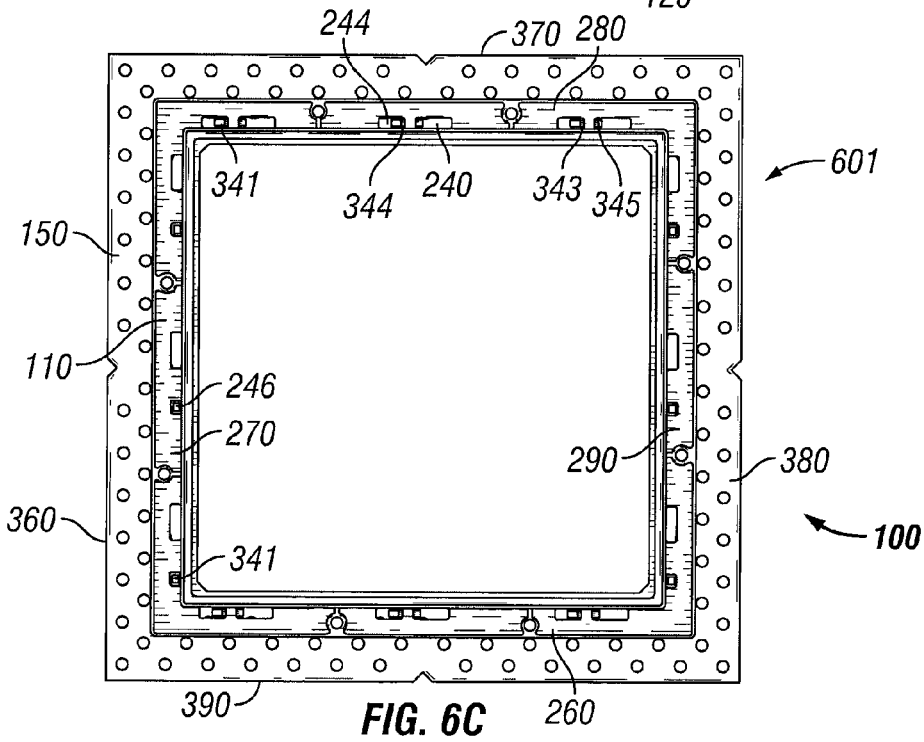
FIG. 6C is a rear view of the rimless adapter of FIG. 6A in accordance with an exemplary embodiment of the present invention.

FIGS. 6A-6C are various views of the rimless adapter 100 oriented in a second orientation 601 in accordance with an exemplary embodiment of the present invention. Referring to FIGS. 6A-6C, the window 365 of the perforated frame 150 is vertically aligned with the label 275 when the perforated frame 150 is coupled to the lower frame 110 in the second orientation 601. The second orientation 601 is formed when the perforated frame 150 is rotated in a counter-clockwise direction by about ninety degrees with respect to the lower frame 110 when the rimless adapter 100 was previously positioned in the first orientation 501 (FIG. 5A). In certain exemplary embodiments where the label 275 is indicated with 1/8", the lip height 122 of the lip 120 that is formed is 1/8". Also, each second step's distal surface 344 is disposed on the base's second surface 212 (FIG. 2A) of the lower frame 110. Hence, each first step 341 is partially disposed and/or inserted through a corresponding slot 240. Specifically, in certain exemplary embodiments, each first step 341 disposed on the first side 360 and the third side 380 are partially inserted into corresponding short slots 246 formed in the second side 270 and the fourth side 290 of the lower frame 110. Also, in certain exemplary embodiments, each first step 341 disposed on the second side 370 and the fourth side 390 are partially inserted into corresponding intermediate slots 244 formed in the first side 260 and the third side 280 of the lower frame 110. Also, none of second and third steps 343, 345 are disposed and/or inserted within any of the slots 240.

Figure 7A:
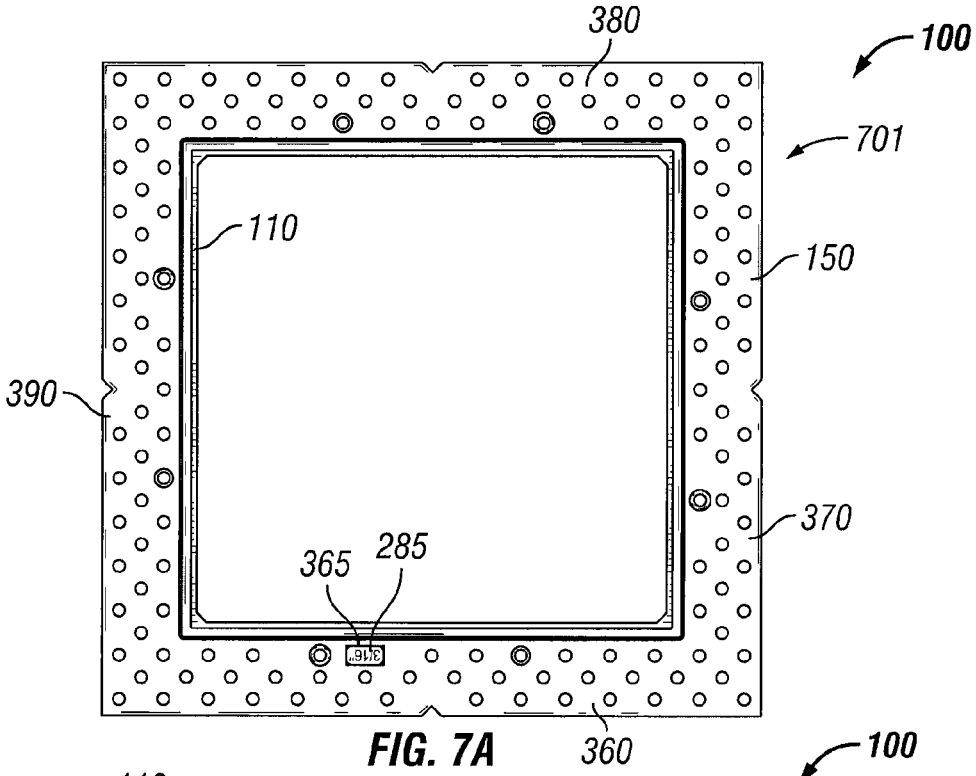
FIG. 7A is a front view of the rimless adapter of FIG. 1 oriented in a third orientation in accordance with an exemplary embodiment of the present invention.
Figure 7B:
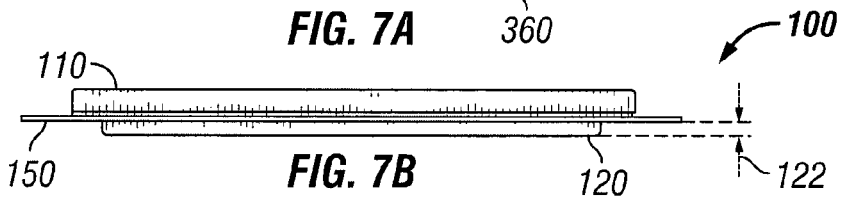
FIG. 7B is a side view of the rimless adapter of FIG. 7A in accordance with an exemplary embodiment of the present invention.
Figure 7C:
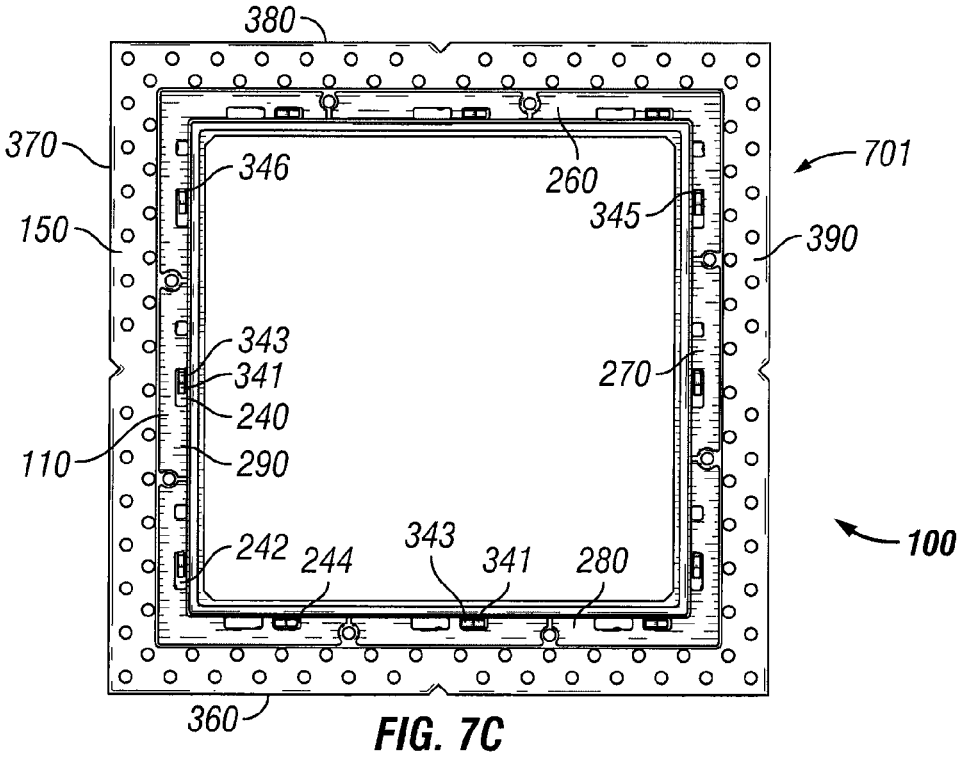
FIG. 7C is a rear view of the rimless adapter of FIG. 7A in accordance with an exemplary embodiment of the present invention.

FIGS. 7A-7C are various views of the rimless adapter 100 oriented in a third orientation 701 in accordance with an exemplary embodiment of the present invention. Referring to FIGS. 7A-7C, the window 365 of the perforated frame 150 is vertically aligned with the label 285 when the perforated frame 150 is coupled to the lower frame 110 in the third orientation 701. The third orientation 701 is formed when the perforated frame 150 is rotated in a counter-clockwise direction by about ninety degrees with respect to the lower frame 110 when the rimless adapter 100 was previously positioned in the second orientation 601 (FIG. 6A). In certain exemplary embodiments where the label 285 is indicated with 3/16", the lip height 122 of the lip 120 that is formed is 3/16". Also, each third step's distal surface 346 is disposed on the base's second surface 212 (FIG. 2A) of the lower frame 110. Hence, each first step 341 and second step 343 are partially disposed and/or inserted through a corresponding slot 240. Specifically, in certain exemplary embodiments, each first step 341 and second step 343 disposed on the first side 360 and the third side 380 are partially inserted into corresponding intermediate slots 244 formed in the first side 260 and the third side 280 of the lower frame 110. Also, in certain exemplary embodiments, each first step 341 and second step 343 disposed on the second side 370 and the fourth side 390 are partially inserted into corresponding long slots 242 formed in the second side 270 and the fourth side 290 of the lower frame 110. Also, the third step 345 is not disposed and/or inserted within any of the slots 240.

Figure 8A:
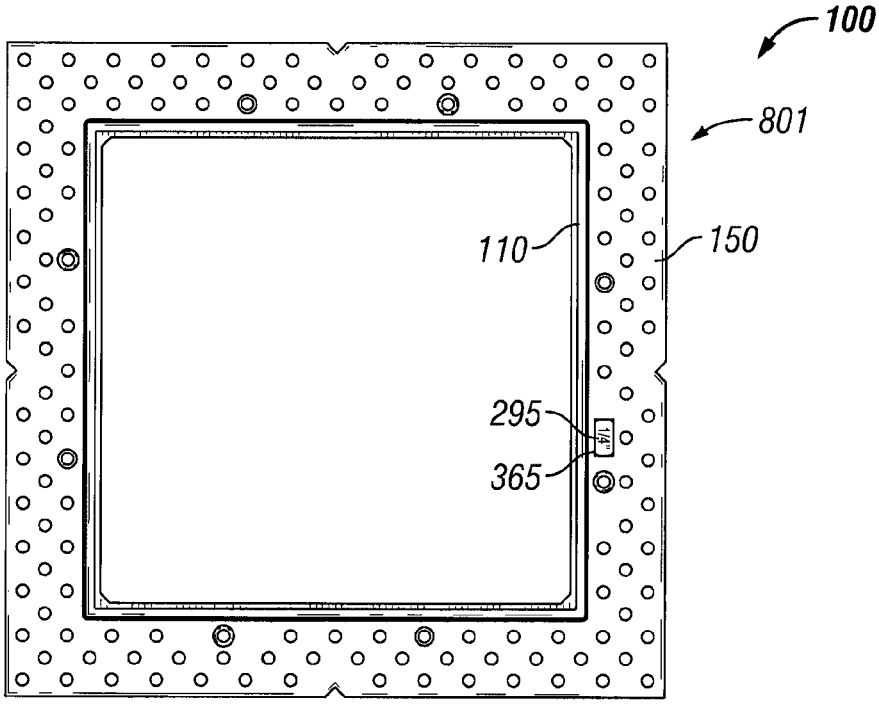
FIG. 8A is a front view of the rimless adapter of FIG. 1 oriented in a fourth orientation in accordance with an exemplary embodiment of the present invention.
Figure 8B:
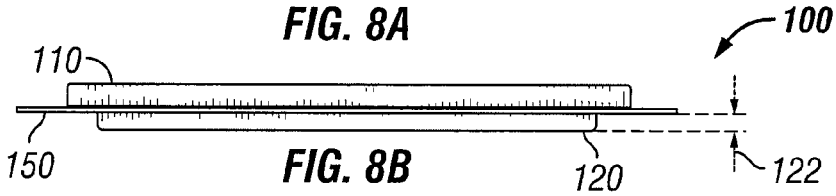
FIG. 8B is a side view of the rimless adapter of FIG. 8A in accordance with an exemplary embodiment of the present invention.
Figure 8C:
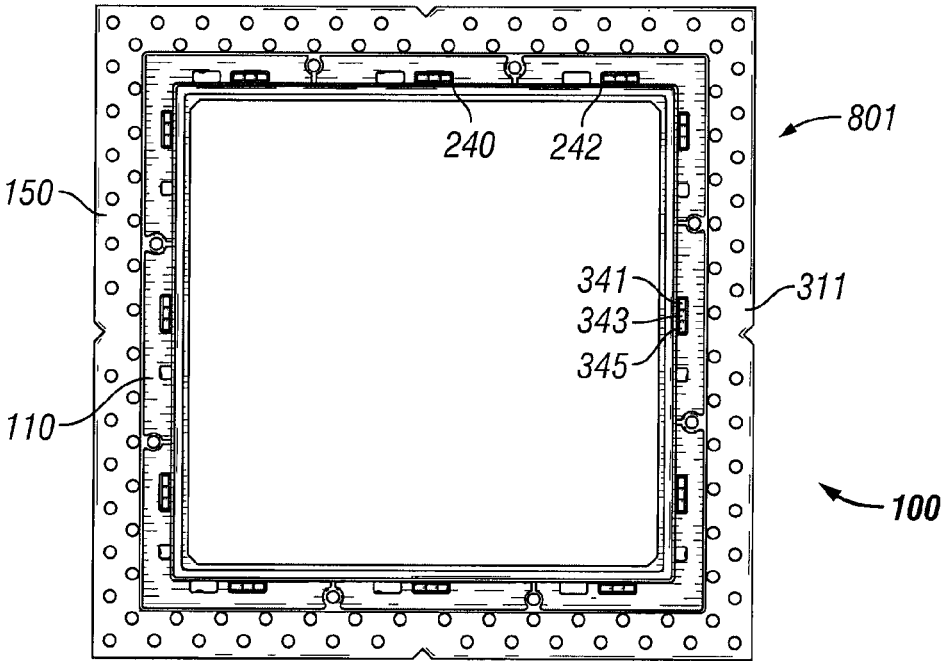
FIG. 8C is a rear view of the rimless adapter of FIG. 8A in accordance with an exemplary embodiment of the present invention.

FIGS. 8A-8C are various views of the rimless adapter 100 oriented in a fourth orientation 801 in accordance with an exemplary embodiment of the present invention. Referring to FIGS. 8A-8C, the window 365 of the perforated frame 150 is vertically aligned with the label 295 when the perforated frame 150 is coupled to the lower frame 110 in the fourth orientation 801. The fourth orientation 801 is formed when the perforated frame 150 is rotated in a counter-clockwise direction by about ninety degrees with respect to the lower frame 110 when the rimless adapter 100 was previously positioned in the third orientation 701 (FIG. 7A). In certain exemplary embodiments where the label 295 is indicated with 1/4", the lip height 122 of the lip 120 that is formed is 1/4". Also, the inner portion 318 (FIG. 3B) of the perforated frame's first surface 311 is disposed on the base's second surface 212 (FIG. 2A) of the lower frame 110. Hence, each first step 341, second step 343, and third step 345 are partially disposed and/or inserted through a corresponding slot 240. Specifically, in certain exemplary embodiments, each first step 341, second step 343, and third step 345 disposed on the perforated frame's first surface 311 are at least partially disposed and/or inserted into corresponding long slots 242 formed in the lower frame 110.

Figure 9A:
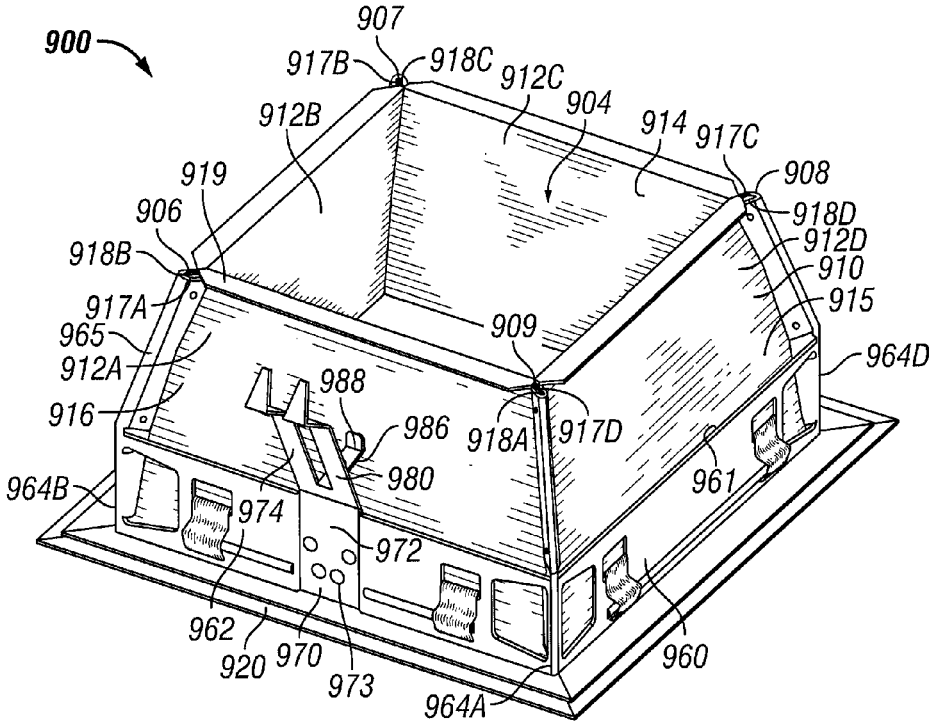
FIG. 9A is a perspective view of a reflector assembly in accordance with an exemplary embodiment of the present invention.
Figure 9B:
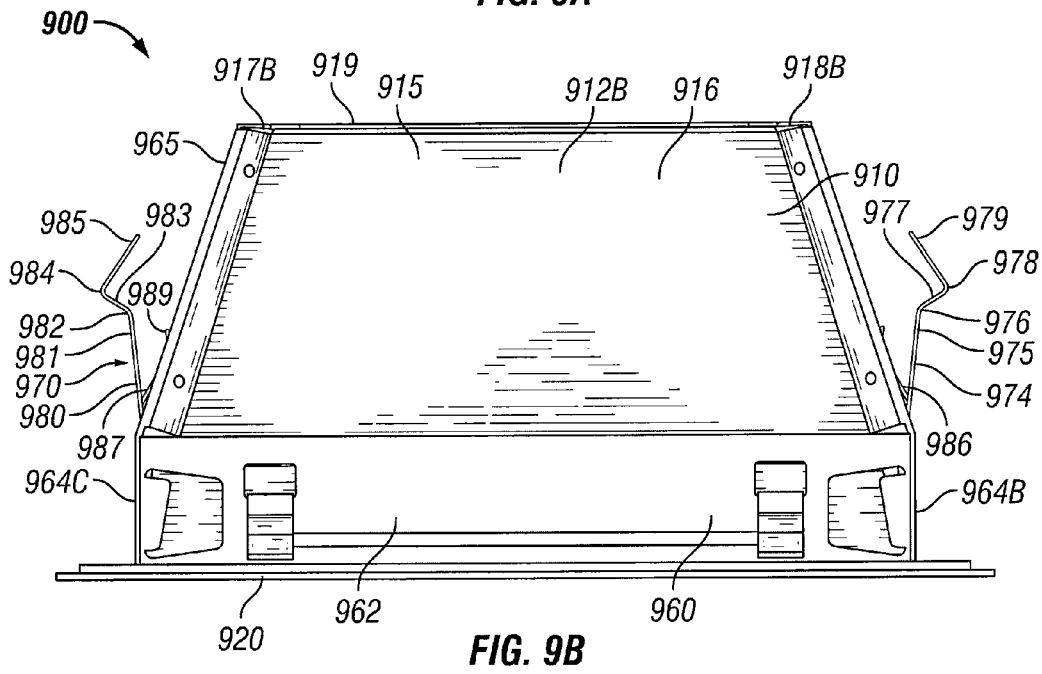
FIG. 9B is a side view of the reflector assembly of FIG. 9A in accordance with an exemplary embodiment of the present invention.

FIG. 9A is a perspective view of a reflector assembly 900 in accordance with an exemplary embodiment of the present invention. FIG. 9B is a side view of the reflector assembly 900 in accordance with an exemplary embodiment of the present invention. Referring to FIGS. 9A and 9B, the reflector assembly 900 includes a reflector 910 and a bracket assembly 960 disposed substantially about the reflector 910. The reflector 910 includes four members 912 joined together at joints 906, 907, 908, 909 to form and surround a light dispersion region 904 that extends axially through the collective members 912 once assembled. There are four members 912A, 912B, 912C, 912D that are coupled together. However, in alternative exemplary embodiments, greater or fewer members 912 are used to form the reflector 910.

Each of the members 912 include a central segment 916, a first side edge 917, a second side edge 918, a top edge 919, and a bottom flange 920. The central segment 916 includes a first surface 914 and a second surface 915 facing an opposite direction than the first surface 914. Once each of the members 912 are assembled to form the reflector 910, which is described in more detail below, the first surface 914 of each member 912 faces the light dispersion region 904. The first side edge 917 and the second side edge 918 are disposed along opposite edges of the central segment 916. Each of the first side edge 917 and the second side edge 918 extends outwardly at an angle from the central segment 916, such that each of the first side edge 917 and the second side edge 918 form about a 135 degree angle with respect to the second surface 915. This angle is greater or less in other exemplary embodiments. Additionally, this angle is different from one member 912 to an adjacent member 912 according to certain exemplary embodiments. Specifically, once the members 912 are assembled together to form the reflector 910, each of the first side edge 917 and the second side edge 918 extends outwardly from the central segment 916 in a direction away from the light dispersion region 904 and towards a portion of the bracket assembly 960. Similarly, the top edge 919 extends outwardly from an upper edge of the central segment 916 in a substantially horizontal plane away from the light dispersion region 904. Similarly, the bottom flange 920 extends outwardly from a lower edge of the central segment 916 in a substantially horizontal plane away from the light dispersion region 904.

Each member 912 is fabricated using a reflective material, such as extruded metal, sheet metal, or die-cast metal. In certain exemplary embodiments, one or more of the members 912 include a protective coating, such as an anodized layer of material. Alternatively, in certain exemplary embodiments, one or more members 912 are fabricated from any non-reflective material and subsequently, the first surface 914, which substantially faces the light dispersion region 904, is made to be reflective, such as by painting the first surface 914 with a reflective paint. According to some exemplary embodiments, the first surface 914 and the second surface 915 is smooth. In alternative exemplary embodiments, at least one of the first surface 914 and/or the second surface 915 is entirely or partially baffled, dimpled, bubbled, faceted, and/or include other known light modifying structures.

The members 912A, 912B, 912C, 912D are oriented to surround and form the light dispersion region 904, which is pyramidic-shaped according to some exemplary embodiments. However, in other exemplary embodiments, the light dispersion region 904 is another geometric or non-geometric shape, such as circular-shaped. Once assembled, the first side edge 917A of member 912A is oriented adjacently to the second side edge 918B of adjacently positioned member 912B to form joint 906. Also, the first side edge 917B of member 912B is oriented adjacently to the second side edge 918C of adjacently positioned member 912C to form joint 907. Further, the first side edge 917C of member 912C is oriented adjacently to the second side edge 918D of adjacently positioned member 912D to form joint 908. Furthermore, the second side edge 918A on member 912A is oriented adjacently to the first side edge 917D of adjacently positioned member 912D to form joint 909. Once assembled, the first surface 914 of each central segment 916 is visible from within the light dispersion region 904. Also, the first side edge 917 and the second side edge 918 of each member 912 are generally not visible from within the light dispersion region 904.

The bracket assembly 960 includes a frame 962 and one or more connectors 970 coupled to the frame 962. The frame 962 has a square-shaped profile having four corners 964A, 964B, 964C, 964D and an aperture 961 extending therethrough. The frame is fabricated as a single component. However, alternatively, the frame 962 is fabricated using several components which are joined together at one or more joints. Each corner 964A, 964B, 964C, 964D of the frame 962 includes at least one clamp 965 extending upwardly and inwardly towards the center axis of the aperture. Each clamp 965 is compressed around at least a portion of a corresponding joint 906, 907, 908, 909. For example, each clamp 965 include a substantially "V"-shaped member that is compressed around its corresponding portion of a joint 906, 907, 908, 909. In certain exemplary embodiments, the clamp 965 is fabricated integrally with its corresponding corner 964A, 964B, 964C, 964D. In alternative exemplary embodiments, one or more clamps 965 are fabricated separately from the frame 962 and thereafter coupled to a corresponding corner 964A, 964B, 964C, 964D.

In addition to securing the bracket assembly 960 to the reflector 910, the clamps 965 provide structural integrity to the reflector 910. For example, the clamps 965 secure each of the first side edge 917 to a corresponding second side edge 918 of each adjacent member 912, thereby maintaining a geometrical relationship between the members 912. In addition, the clamps 965 prevent light from leaking out from the light dispersion region 904 along the joints 906, 907, 908, 909. For example, by providing clamps 965 that extend along a significant portion of the joint 906, 907, 908, 909, the clamps 965 prevent gaps from forming between the members 912 and also reflects light transmitted through any such gaps, if formed, back into the light dispersion region 904.

Each connector 970 includes a base portion 972, a first finger portion 974, a second finger portion 980, and a biasing portion 986. The base portion 972, the first finger portion 974, the second finger portion 980, and the biasing portion 986 are fabricated as a single component. However, in alternative exemplary embodiments, one or more of the base portion 972, the first finger portion 974, the second finger portion 980, and the biasing portion 986 are separately formed and thereafter coupled to one another to form the connector 970.

The base portion 972 is substantially planar and is coupled to one side of the frame 962. According to some exemplary embodiments, the base portion 972 is coupled to one side of the frame 962 such that the base portion 972 is centrally positioned along the length of that one side of the frame 962. However, the base portion 972 is not centrally positioned along the length of that one side of the frame 962 according to certain exemplary embodiments. The base portion 972 is coupled to the frame 962 using fasteners 973, such as rivets, screws, nails, adhesives, or other known coupling devices.

The first finger portion 974 generally extends upwardly from a top edge of the base portion 974 towards the top edge 919 of the reflector 910. The first finger portion 974 includes an initial portion 975, an intermediate portion 977, and an end portion 979. The initial portion 975 extends generally upwardly from a top edge of the base portion 974 to the intermediate portion 977. In some exemplary embodiments, the initial portion 975 extends in an upward and angular direction away from the reflector 910. According to certain exemplary embodiments, the initial portion 975 is substantially planar. However, in other exemplary embodiments, the initial portion 975 is non-planar. The intermediate portion 977 extends upwardly from the initial portion 975 to the end portion 977. Thus, a first interface 976 is formed between the initial portion 975 and the intermediate portion 977. According to certain exemplary embodiments, the intermediate portion 977 is substantially planar. However, in other exemplary embodiments, the intermediate portion 977 is non-planar. The intermediate portion 977 extends from the initial portion 975 in an upward and angular direction away from the reflector 910. The end portion 979 extends upwardly from the intermediate portion 977 towards the top edge 919 of the reflector 910. Thus, a second interface 978 is formed between the intermediate portion 977 and the end portion 979. According to certain exemplary embodiments, the end portion 979 is substantially planar. However, in other exemplary embodiments, the end portion 979 is non-planar. The end portion 979 extends from the intermediate portion 977 in an upward and angular direction towards the reflector 910.

The second finger portion 980 is shaped and oriented similar to the first finger portion 974. The second finger portion 980 generally extends upwardly from a top edge of the base portion 974 towards the top edge 919 of the reflector 910. The second finger portion 974 also includes an initial portion 981, an intermediate portion 983, and an end portion 985. The initial portion 981 extends generally upwardly from a top edge of the base portion 974 to the intermediate portion 983. In some exemplary embodiments, the initial portion 981 extends in an upward and angular direction away from the reflector 910. According to certain exemplary embodiments, the initial portion 981 is substantially planar. However, in other exemplary embodiments, the initial portion 981 is non-planar. The intermediate portion 983 extends upwardly from the initial portion 981 to the end portion 985. Thus, a first interface 982 is formed between the initial portion 981 and the intermediate portion 983. According to certain exemplary embodiments, the intermediate portion 983 is substantially planar. However, in other exemplary embodiments, the intermediate portion 983 is non-planar. The intermediate portion 983 extends from the initial portion 981 in an upward and angular direction away from the reflector 910. The end portion 985 extends upwardly from the intermediate portion 983 towards the top edge 919 of the reflector 910. Thus, a second interface 984 is formed between the intermediate portion 983 and the end portion 985. According to certain exemplary embodiments, the end portion 985 is substantially planar. However, in other exemplary embodiments, the end portion 985 is non-planar. The end portion 985 extends from the intermediate portion 983 in an upward and angular direction towards the reflector 910.

The biasing portion 986 generally extends upwardly from a top edge of the base portion 974 towards the reflector 910. The biasing portion 986 is positioned between the first finger portion 974 and the second finger portion 980 according to certain exemplary embodiments. However, the positioning of the biasing portion 980 is different in other exemplary embodiments. The biasing portion 986 includes an initial portion 987 and an end portion 989. The initial portion 987 extends generally upwardly from a top edge of the base portion 974 to the end portion 987. In some exemplary embodiments, the initial portion 987 extends in an upward and angular direction towards the reflector 910. According to certain exemplary embodiments, the initial portion 987 is substantially planar. However, in other exemplary embodiments, the initial portion 987 is non-planar. The end portion 989 extends upwardly from the initial portion 987 towards the top edge 919 of the reflector 910. Thus, a first interface 988 is formed between the initial portion 987 and the end portion 989. According to the exemplary embodiments, a portion of the first interface 988 is in contact with or is positioned near the adjacent central segment 916 of the reflector 910. According to certain exemplary embodiments, the end portion 989 is substantially planar. However, in other exemplary embodiments, the end portion 989 is non-planar. The end portion 989 extends from the initial portion 987 in an upward direction, substantially parallel with the base portion 972, towards the top edge 919 of the reflector 910. In some alternative exemplary embodiments, the end portion 989 extends from the initial portion 987 in an upward and angular direction away from the reflector 910.

There are two connectors 970 coupled to opposing sides of the frame 962. In alternative exemplary embodiments, one or more connectors 970 are coupled to one or more sides of the frame 962. For example, two connectors 970 are coupled to one side of the frame, while one connector 970 is coupled to an opposing side of the frame 962. In some exemplary embodiments, one or more connectors 970 are coupled around the perimeter of the frame 962, such as when the frame 962 is circularly-shaped and has no sides.

Figure 10:
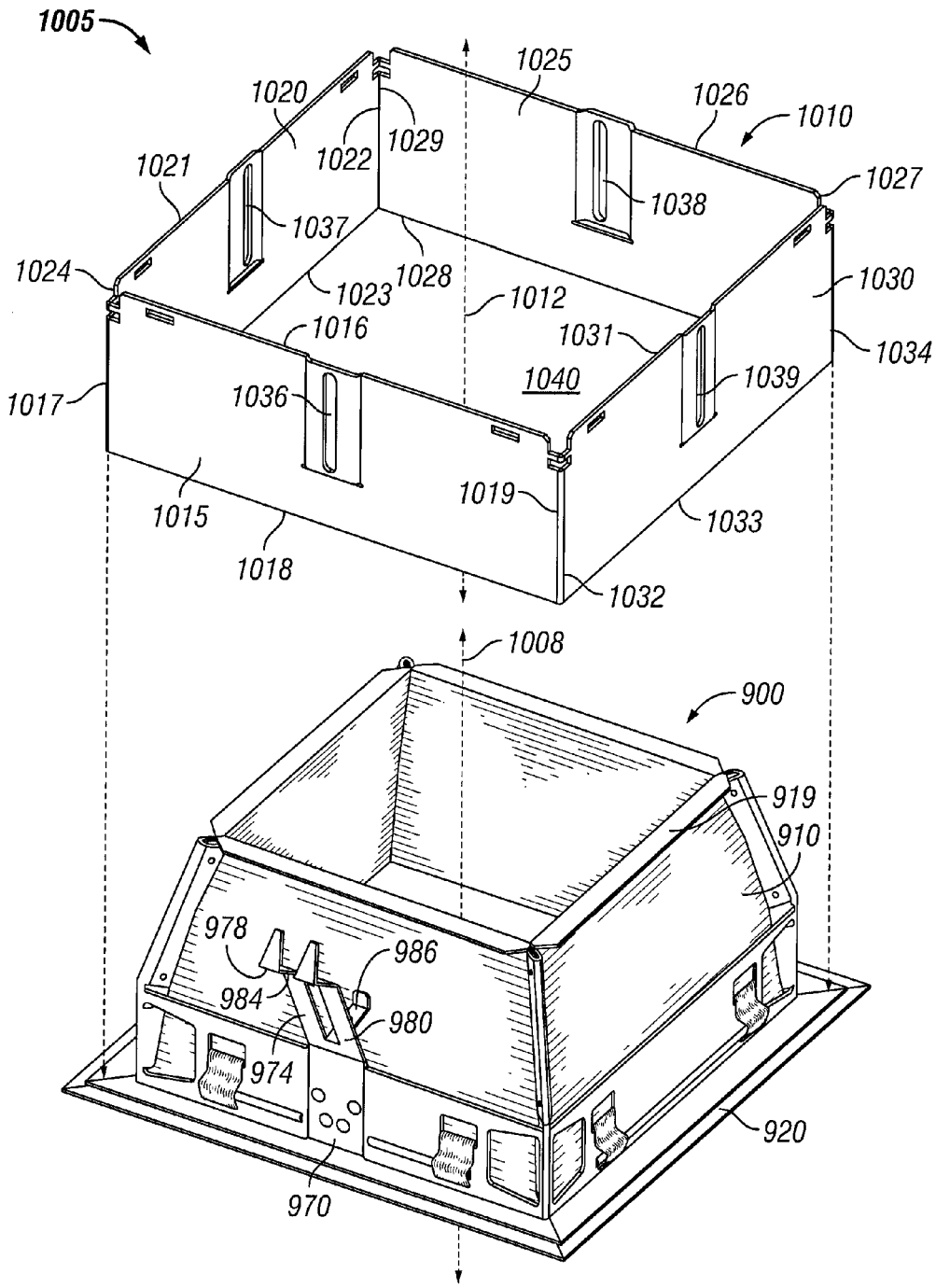
FIG. 10 is a perspective view of the reflector assembly of FIG. 9A during a first stage of assembly in accordance with an exemplary embodiment of the present invention.
Figure 11:
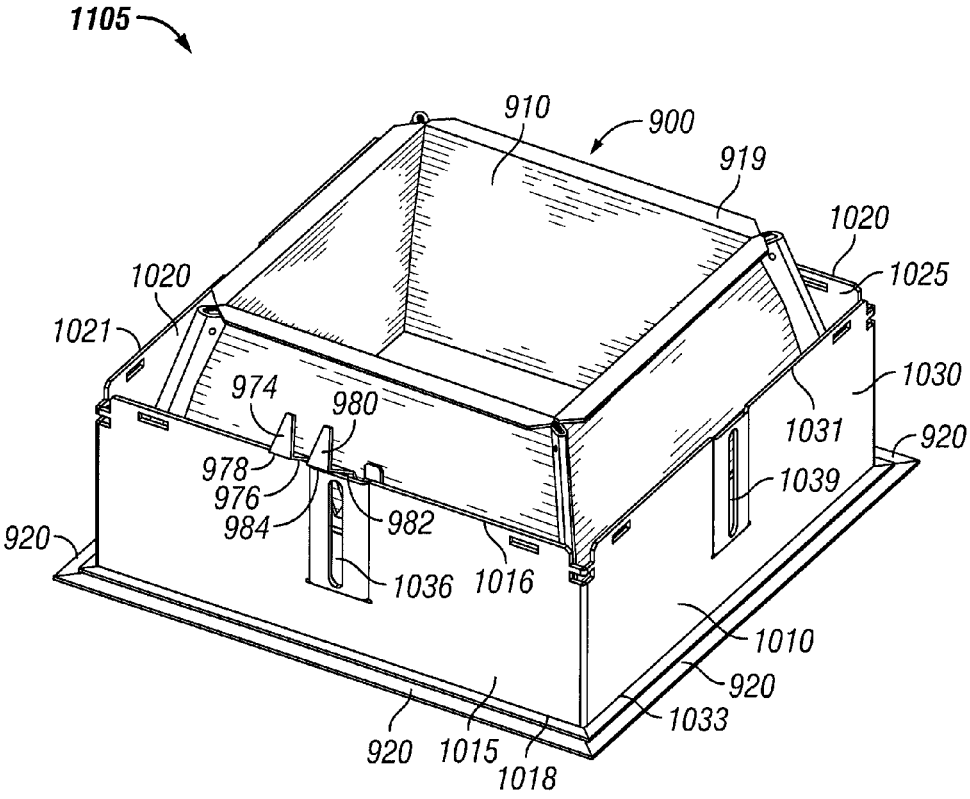
FIG. 11 is a perspective view of the reflector assembly of FIG. 9A during a second stage of assembly in accordance with an exemplary embodiment of the present invention.

FIG. 10 is a perspective view of the reflector assembly 900 during a first stage 1005 of assembly in accordance with an exemplary embodiment of the present invention. FIG. 11 is a perspective view of the reflector assembly 900 during a second stage 1105 of assembly in accordance with an exemplary embodiment of the present invention. Referring to FIGS. 10 and 11, the reflector assembly 900 is oriented below a collar 1010 during the first stage 1005 of assembly, such that a center axis 1008 of the reflector assembly 900 is substantially aligned with a center axis 1012 of the collar 1010. Also, the top edges 919 of the reflector 910 is oriented elevationally higher than the bottom flanges 920 of the reflector 910. The collar 1010 is typically installed or positioned within a light fixture housing (not shown) and is disposed substantially above a ceiling (not shown) during the first stage 1005. Alternatively, the collar 1010 is fabricated as a portion of the housing itself.

The collar 1010 has a substantially square-shaped profile and includes a first side 1015, a second side 1020, a third side 1025, and a fourth side 1030. Although the collar 1010 has a square-shaped profile, the collar 1010 has a differently shaped profile in other exemplary embodiments. The first side 1015 is substantially planar and includes a top edge 1016, a first side edge 1017, a bottom edge 1018, and a second side edge 1019. The top edge 1016 is substantially parallel to the bottom edge 1018. The first side edge 1017 extends from one end of the top edge 1016 to one end of the bottom edge 1018. The second side edge 1019 extends from an opposing end of the top edge 1016 to an opposing end of the bottom edge 1018. A slot 1036 is formed within the first side 1015 and extends in a longitudinal direction which is substantially perpendicular to the bottom edge 1018. According to some exemplary embodiments, the slot 1036 is formed substantially halfway along the length of the first side 1015. However, the slot 1036 is formed at a different location along the length of the first side 1015 and/or in a non-perpendicular manner with respect to the bottom edge 1018 in other exemplary embodiments. The slot 1036 is used for coupling the collar 1010 to the housing at different elevation heights. For example, a fastener (not shown), such as a screw, rivet, or nail, is inserted through the slot 1036 and into a receiving hole (not shown) formed within the housing. The collar 1010 is vertically adjusted within the housing to a desired elevation with respect to the housing prior to the fastener being tightened.

Similarly, the second side 1020 is substantially planar and includes a top edge 1021, a first side edge 1022, a bottom edge 1023, and a second side edge 1024. The top edge 1021 is substantially parallel to the bottom edge 1023. The first side edge 1022 extends from one end of the top edge 1021 to one end of the bottom edge 1023. The second side edge 1024 extends from an opposing end of the top edge 1021 to an opposing end of the bottom edge 1023. A slot 1037 is formed within the second side 1020 and extends in a longitudinal direction which is substantially perpendicular to the bottom edge 1023. According to some exemplary embodiments, the slot 1037 is formed substantially halfway along the length of the second side 1020. However, the slot 1037 is formed at a different location along the length of the second side 1020 and/or in a non-perpendicular manner with respect to the bottom edge 1023 in other exemplary embodiments. The slot 1037 is used for coupling the collar 1010 to the housing at different elevation heights. For example, a fastener (not shown), such as a screw, rivet, or nail, is inserted through the slot 1037 and into a receiving hole (not shown) formed within the housing. The collar 1010 is vertically adjusted within the housing to a desired elevation with respect to the housing prior to the fastener being tightened.

Similarly, the third side 1025 is substantially planar and includes a top edge 1026, a first side edge 1027, a bottom edge 1028, and a second side edge 1029. The top edge 1026 is substantially parallel to the bottom edge 1028. The first side edge 1027 extends from one end of the top edge 1026 to one end of the bottom edge 1028. The second side edge 1029 extends from an opposing end of the top edge 1026 to an opposing end of the bottom edge 1028. A slot 1038 is formed within the third side 1025 and extends in a longitudinal direction which is substantially perpendicular to the bottom edge 1028. According to some exemplary embodiments, the slot 1038 is formed substantially halfway along the length of the third side 1025. However, the slot 1038 is formed at a different location along the length of the third side 1025 and/or in a non-perpendicular manner with respect to the bottom edge 1028 in other exemplary embodiments. The slot 1038 is used for coupling the collar 1010 to the housing at different elevation heights. For example, a fastener (not shown), such as a screw, rivet, or nail, is inserted through the slot 1038 and into a receiving hole (not shown) formed within the housing. The collar 1010 is vertically adjusted within the housing to a desired elevation with respect to the housing prior to the fastener being tightened.

Similarly, the fourth side 1030 is substantially planar and includes a top edge 1031, a first side edge 1032, a bottom edge 1033, and a second side edge 1034. The top edge 1031 is substantially parallel to the bottom edge 1033. The first side edge 1032 extends from one end of the top edge 1031 to one end of the bottom edge 1033. The second side edge 1034 extends from an opposing end of the top edge 1031 to an opposing end of the bottom edge 1033. A slot 1039 is formed within the fourth side 1030 and extends in a longitudinal direction which is substantially perpendicular to the bottom edge 1033. According to some exemplary embodiments, the slot 1039 is formed substantially halfway along the length of the fourth side 1030. However, the slot 1039 is formed at a different location along the length of the fourth side 1030 and/or in a non-perpendicular manner with respect to the bottom edge 1033 in other exemplary embodiments. The slot 1039 is used for coupling the collar 1010 to the housing at different elevation heights. For example, a fastener (not shown), such as a screw, rivet, or nail, is inserted through the slot 1039 and into a receiving hole (not shown) formed within the housing. The collar 1010 is vertically adjusted within the housing to a desired elevation with respect to the housing prior to the fastener being tightened.

The collar 1010 is formed once the first side 1015, the second side 1020, the third side 1025, and the fourth side 1030 are coupled together. The first side edge 1017 of the first side 1015 is coupled to the second side edge 1024 of the second side 1020. The first side edge 1022 of the second side 1020 is coupled to the second side edge 1029 of the third side 1025. The first side edge 1027 of the third side 1025 is coupled to the second side edge 1034 of the fourth side 1030. The first side edge 1032 of the fourth side 1030 is coupled to the second side edge 1019 of the first side 1015. Hence, a cavity 1040 is formed within the collar 1010 and is surrounded by the first side 1015, the second side 1020, the third side 1025, and the fourth side 1030. The collar 1010 is fabricated as a single component according to certain exemplary embodiments. However, in other exemplary embodiments, the collar 1010 is formed from several components individually formed and subsequently coupled thereafter to form the collar 1010.

When proceeding from the first stage 1005 of assembly to the second stage of assembly 1105, the reflector assembly 900 is inserted into the cavity 1040 of the collar 1010. The top edges 919 of the reflector 910 are initially inserted into the cavity 1040 near the bottom edges 1018, 1023, 1028, 1033 of the collar 1010 and then raised within the cavity 1040 towards the top edges 1016, 1021, 1026, 1031. The first finger portion 974 and the second finger portion 980 of each connector 970 are compressed toward the reflector 910 by the collar 1010. At the same time, the biasing portion 986 of each connector 970 is pushing against the reflector 910 and attempting to push the first finger portion 974 and the second finger portion 980 of each connector 970 away from the reflector 910. Once the second interface 978 of the first finger portion 974 of each connector 970 and the second interface 984 of the second finger portion 980 of each connector 970 are exposed elevationally above the top edges 1016, 1021, 1026, 1031 of the collar 1010, the first finger portion 974 and the second finger portion 980 of each connector 970 begin moving away from the reflector 910. These first finger portions 974 and second finger portions 980 continue to move away from the reflector 910 as the reflector assembly 900 is further inserted within the collar 1010. Once the first interface 976 of the first finger portion 974 of each connector 970 and the first interface 982 of the second finger portion 980 of each connector 970 are exposed elevationally above the top edges 1016, 1021, 1026, 1031 of the collar 1010, the first finger portion 974 and the second finger portion 980 of each connector 970 cease moving away from the reflector 910. At this time, the second stage 1105 of the assembly is reached. In this position, the first finger provides constant pressure on the collar edge and pulling force for the reflector assembly, thereby keeping the reflector assembly in place. In certain exemplary embodiments, the bottom edges 1018, 1023, 1028, 1033 of the collar 1010 are disposed on or near the bottom flanges 920 of the reflector 910.

Figure 12:
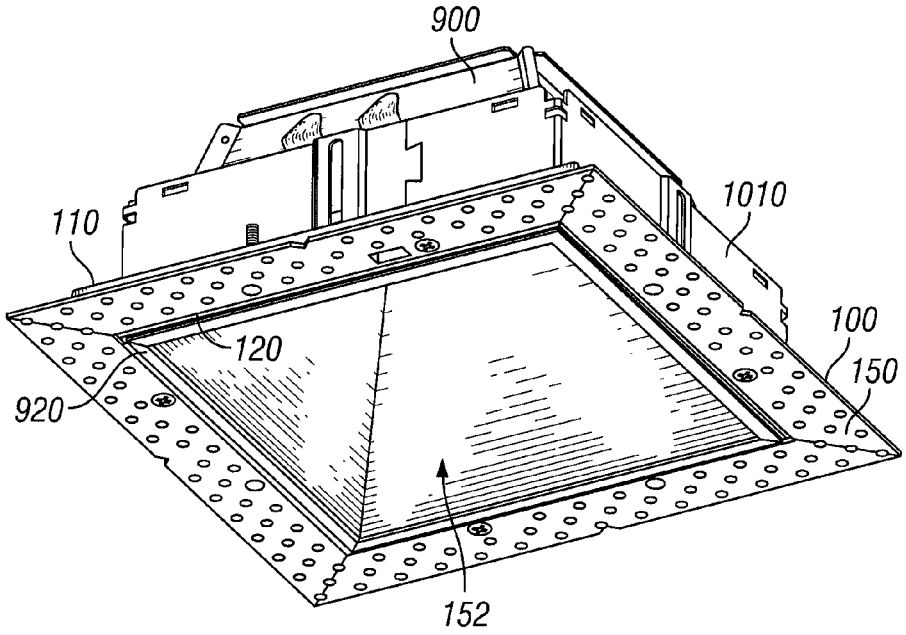
FIG. 12 is a perspective view of the reflector assembly of FIG. 9A coupled to the rimless adapter of FIG. 1 and the collar shown in FIG. 10 in accordance with an exemplary embodiment of the present invention.
Figure 13:
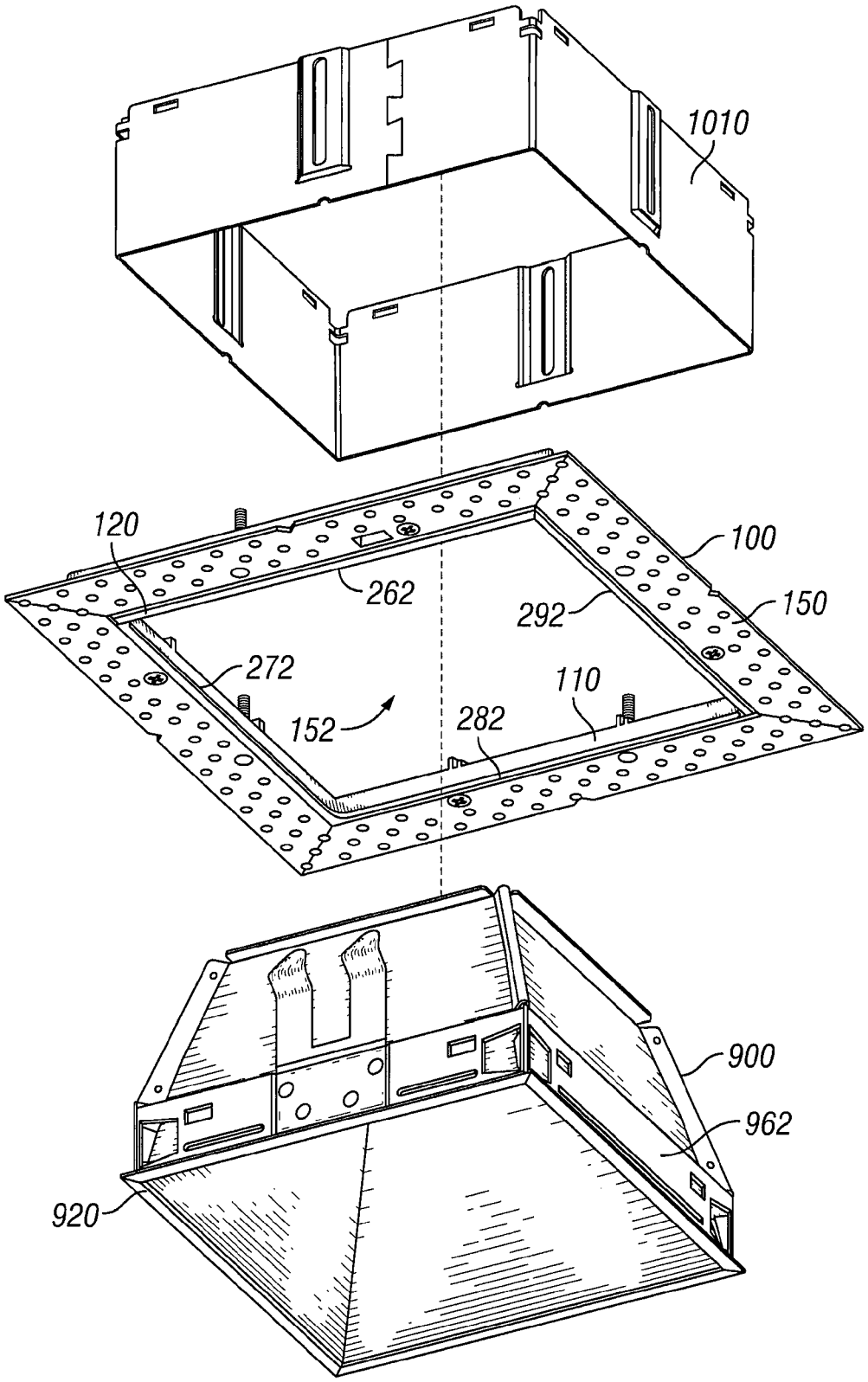
FIG. 13 is an exploded view of the reflector assembly of FIG. 9A coupled to the rimless adapter of FIG. 1 and the collar shown in FIG. 10 in accordance with an exemplary embodiment of the present invention.

FIG. 12 is a perspective view of the reflector assembly 900 coupled to the rimless adapter 100 and the collar 1010 in accordance with an exemplary embodiment of the present invention. FIG. 13 is an exploded view of the reflector assembly 900 coupled to the rimless adapter 100 and the collar 1010 in accordance with an exemplary embodiment of the present invention. Referring to FIGS. 12 and 13, the lower frame 110 is assembled to the perforated frame 150 to provided for a desired height of the lip 120 according to the description provided above. The reflector assembly 900 is inserted into the passageway 152 from the side of the rimless adapter 100 that includes the lip 120. The reflector assembly 900 proceeds through this passageway 152 until the bottom flange 920 is impeded by the lip 120. The perimeter of the flange 920 is greater than the perimeter of the lip 120. Once the bottom flange 920 is impeded by the lip 120, the collar 1010 is coupled to the reflector assembly 900 according to the description previously provided.

Although each exemplary embodiment has been described in detail, it is to be construed that any features and modifications that are applicable to one embodiment are also applicable to the other embodiments. Furthermore, although the invention has been described with reference to specific embodiments, these descriptions are not meant to be construed in a limiting sense. Various modifications of the disclosed embodiments, as well as alternative embodiments of the invention will become apparent to persons of ordinary skill in the art upon reference to the description of the exemplary embodiments. It should be appreciated by those of ordinary skill in the art that the conception and the specific embodiments disclosed may be readily utilized as a basis for modifying or designing other structures or methods for carrying out the same purposes of the invention. It should also be realized by those of ordinary skill in the art that such equivalent constructions do not depart from the spirit and scope of the invention as set forth in the appended claims. It is therefore, contemplated that the claims will cover any such modifications or embodiments that fall within the scope of the invention.

What is claimed is:

1. A reflector assembly, comprising:

a reflector comprising a reflective inner surface;

a frame surrounding a portion of the reflector and coupled to at least a portion of an external surface of the reflector; and one or more connectors coupled to the frame, each connector comprising:

a base portion coupled to the frame;

a first finger portion extending in a generally upward direction from a portion of the base portion towards a top portion of the reflector and generally angled away from the reflector; and a biasing portion extending in a generally upward and angled direction from a portion of the base portion towards the reflector, wherein the biasing portion exerts a force on a side of the reflector when the first finger portion is compressed inwardly towards the side of the reflector, wherein the frame is positioned between the base portion of each connector and the portion of the reflector, and wherein the base portion of each connector is attached to the frame by one or more fasteners.

2. The reflector assembly of claim 1, wherein the biasing portion is in contact with a side of the reflector.

3. The reflector assembly of claim 1, wherein the first finger portion comprises:

an initial portion extending in a generally upward direction from a portion of the base portion towards a top portion of the reflector; and an intermediate portion extending in a generally upward direction from the initial portion towards a top portion of the reflector and angled away from the reflector.

4. The reflector assembly of claim 3, wherein the first finger portion further comprises an end portion extending in a generally upward direction from the intermediate portion towards a top portion of the reflector and angled towards the reflector.

5. The reflector assembly of claim 1, further comprising a second finger portion extending in a generally upward direction from a portion of the base portion towards a top portion of the reflector and generally angled away from the reflector.

6. The reflector assembly of claim 5, wherein the biasing portion is positioned between the first finger portion and the second finger portion.

7. The reflector assembly of claim 1, wherein a first connector is coupled at one end of the frame and a second connector is coupled to an opposite end of the frame.

8. The reflector assembly of claim 1, wherein the frame comprises a square-shaped profile.

9. A method of installing a reflector assembly into a collar, comprising:

providing a collar comprising a bottom end, a top end, and a sidewall extending from the bottom end to the top end, the sidewall surrounding an opening formed therein;

orienting a reflector assembly below the bottom end of the collar, the reflector assembly comprising:

a reflector comprising a reflective inner surface;

a frame surrounding a portion of the reflector and coupled to at least a portion of an external surface of the reflector; and one or more connectors coupled to the frame, each connector comprising:

a base portion coupled to the frame;

a first finger portion extending in a generally upward direction from a portion of the base portion towards a top portion of the reflector and generally angled away from the reflector; and a biasing portion extending in a generally upward and angled direction from a portion of the base portion towards the reflector;

inserting the reflector assembly into the opening of the collar;

compressing the first finger toward the reflector, the biasing portion exerting a force on the reflector;

moving the first finger away from the reflector once a portion of the first finger has passed through the opening of the collar.

10. The method of claim 9, wherein each connector further comprises a second finger portion extending in a generally upward direction from a portion of the base portion towards a top portion of the reflector and generally angled away from the reflector.

11. The method of claim 10, wherein the biasing portion is positioned between the first finger portion and the second finger portion.

12. A reflector assembly, comprising:

a reflector comprising a reflective inner surface;

a frame surrounding a portion of the reflector and coupled to at least a portion of an external surface of the reflector;

one or more connectors coupled to the frame, each connector comprising:

a base portion coupled to the frame;

a first finger portion extending in a generally upward direction from a portion of the base portion towards a top portion of the reflector and generally angled away from the reflector; and a biasing portion extending in a generally upward and angled direction from a portion of the base portion towards the reflector; and a collar surrounding the frame, wherein the biasing portion exerts a force on a side of the reflector when the first finger portion is compressed inwardly towards the side of the reflector and wherein the first finger portion presses against a top edge of the collar when the first finger portion extends above the top edge of the collar.

13. The reflector assembly of claim 12, wherein the biasing portion is in contact with a side of the reflector.

14. The reflector assembly of claim 12, wherein the first finger portion comprises:

an initial portion extending in a generally upward direction from a portion of the base portion towards a top portion of the reflector; and an intermediate portion extending in a generally upward direction from the initial portion towards a top portion of the reflector and angled away from the reflector.

15. The reflector assembly of claim 14, wherein the first finger portion further comprises an end portion extending in a generally upward direction from the intermediate portion towards a top portion of the reflector and angled towards the reflector.

16. The reflector assembly of claim 12, further comprising a second finger portion extending in a generally upward direction from a portion of the base portion towards a top portion of the reflector and generally angled away from the reflector.

17. The reflector assembly of claim 16, wherein the biasing portion is positioned between the first finger portion and the second finger portion.

18. The reflector assembly of claim 12, wherein a first connector is coupled at one end of the frame and a second connector is coupled to an opposite end of the frame.

19. The reflector assembly of claim 12, wherein the frame comprises a square-shaped profile.

20. The reflector assembly of claim 12, wherein each particular connector further includes a second finger portion extending in the generally upward direction from the portion of the base portion of the particular connector towards a top portion of the reflector and generally angled away from the reflector.

* * * * *